US011105185B2

(12) United States Patent
Spencer et al.

(10) Patent No.: US 11,105,185 B2
(45) Date of Patent: Aug. 31, 2021

(54) FLUID DELIVERY DEVICE FOR A HYDRAULIC FRACTURING SYSTEM

(71) Applicant: S.P.M. Flow Control, Inc., Fort Worth, TX (US)

(72) Inventors: Gideon Nathaniel Junqueira Spencer, Fort Worth, TX (US); Justin Lane Poehls, Fort Worth, TX (US); Jeffrey Haiderer, Fort Worth, TX (US); Connor Landrum, Burleson, TX (US); Scott Alan Skurdalsvold, Mansfield, TX (US); Paul Steele, Midlothian, TX (US); Trever Dean Stewart, Fort Worth, TX (US)

(73) Assignee: S.P.M Flow Control, Inc., Fort Worth, TX (US)

( * ) Notice: Subject to any disclaimer, the term of this patent is extended or adjusted under 35 U.S.C. 154(b) by 55 days.

(21) Appl. No.: 16/119,625

(22) Filed: Aug. 31, 2018

(65) Prior Publication Data

US 2019/0071951 A1 Mar. 7, 2019

Related U.S. Application Data

(60) Provisional application No. 62/553,279, filed on Sep. 1, 2017, provisional application No. 62/553,231, filed on Sep. 1, 2017.

(51) Int. Cl.
*E21B 41/00* (2006.01)
*E21B 43/26* (2006.01)

(52) U.S. Cl.
CPC ..... *E21B 41/00* (2013.01); *E21B 43/26* (2013.01)

(58) Field of Classification Search
CPC ..... E21B 41/00; E21B 43/26
USPC ..... 166/308.1
See application file for complete search history.

(56) References Cited

U.S. PATENT DOCUMENTS

| | | | |
|---|---|---|---|
| 3,766,986 | A | 10/1973 | Kiel |
| 4,569,394 | A | 2/1986 | Sweatman et al. |
| 4,726,219 | A | 2/1988 | Pearson et al. |
| 4,850,702 | A | 7/1989 | Arribau et al. |

(Continued)

OTHER PUBLICATIONS

Young, Lee W., "International Search Report", International Application No. PCT/US18/49144, dated Nov. 2, 2018, 3 pages.

(Continued)

*Primary Examiner* — Matthew R Buck
*Assistant Examiner* — Patrick F Lambe
(74) *Attorney, Agent, or Firm* — Foley & Lardner LLP

(57) ABSTRACT

A fluid delivery device for a hydraulic fracturing system includes a fluid conduit having a fracking fluid outlet configured to be fluidly connected to a well head for delivering a fracking fluid to the well head. The fluid conduit includes a base fluid inlet configured to be fluidly connected to the outlet of a frac pump such that the fluid conduit is configured to receive a flow of base fluid from the frac pump. An injection system is fluidly connected to the fluid conduit downstream from the base fluid inlet and upstream from the fracking fluid outlet. The injection system is configured to be fluidly connected to a material source. The injection system is configured to inject at least one material of the fracking fluid from the material source into the fluid conduit downstream from the frac pump to generate the fracking fluid within the fluid conduit.

19 Claims, 10 Drawing Sheets

(56) References Cited

U.S. PATENT DOCUMENTS

| | | | | |
|---|---|---|---|---|
| 8,701,774 | B2 | 4/2014 | Johnson, Sr. | |
| 8,746,338 | B2 | 6/2014 | Weinstein et al. | |
| 9,945,216 | B2 | 4/2018 | Ghasripoor et al. | |
| 2003/0161212 | A1 | 8/2003 | Neal et al. | |
| 2005/0006089 | A1* | 1/2005 | Justus | E21B 43/267 166/250.01 |
| 2011/0272158 | A1 | 10/2011 | Neal | |
| 2014/0000899 | A1* | 1/2014 | Nevison | E21B 43/26 166/308.1 |
| 2015/0000766 | A1 | 1/2015 | Arizpe et al. | |

OTHER PUBLICATIONS

Young, Lee W., "Written Opinion of the International Searching Authority", International Application No. PCT/US18/49144, dated Nov. 2, 2018, 10 pages.

* cited by examiner

FLUID DELIVERY DEVICE FOR A HYDRAULIC FRACTURING SYSTEM

CROSS-REFERENCE TO RELATED APPLICATION

This application claims priority to and the benefit of U.S. Provisional Patent Application Ser. No. 62/553,279 filed on Sep. 1, 2017 and entitled "INJECTION DEVICE FOR ADDING MATERIAL TO A HYDRAULIC FRACTURING SYSTEM AFTER THE FLUID END," and U.S. Provisional Patent Application Ser. No. 62/553,231 filed on Sep. 1, 2017 and entitled "DEVICE USED FOR ADDING MATERIAL TO A HYDRAULIC FRACTURING SYSTEM AFTER THE PUMP FLUID END," which are each incorporated herein by reference in their entirety.

TECHNICAL FIELD

This disclosure relates to hydraulic fracturing systems, and in particular, to fluid delivery devices for hydraulic fracturing systems.

BACKGROUND OF THE DISCLOSURE

In oilfield operations, reciprocating pumps are used for different fracturing operations such as fracturing subterranean formations to drill for oil or natural gas, cementing a wellbore, or treating the wellbore and/or formation. A reciprocating pump designed for fracturing operations is sometimes referred to as a "frac pump." A reciprocating pump typically includes a power end and a fluid end (sometimes referred to as a cylindrical section). The fluid end is typically formed of a one piece construction or a series of blocks secured together by rods. The fluid end includes a fluid cylinder having a plunger passage for receiving a plunger or plunger throw, an inlet passage that holds an inlet valve assembly, and an outlet passage that holds an outlet valve assembly.

Conventional systems used for hydraulic fracturing consist of a blender that mixes a base fluid (e.g., water, liquefied petroleum gas (LPG), propane, etc.) with one or more other materials (e.g., a slurry, sand, acid, proppant, a sand and base fluid mixture, a gel, a foam, a compressed gas, etc.) to form a fracturing fluid, which is sometimes referred to as a "fracking fluid." The fracking fluid is transported to the fluid end of the frac pump via a low-pressure line. The fluid end of the frac pump pumps the fracking fluid to the well head via a high-pressure line. Thus, the fluid end of the frac pump is currently the point of transition of the fracking fluid from low pressure to high pressure in the hydraulic fracturing system. Specifically, the fluid end brings the fracking fluid in from the low-pressure line and forces it out into the high-pressure line. The fracking fluid often contains solid particulates and/or corrosive material such that the fracking fluid can be relatively abrasive.

Over time, the flow of the abrasive fracking fluid through the fluid end of the frac pump can erode and wears down the interior surfaces (e.g., the various internal passages, etc.) and/or the internal components (e.g., valves, seats, springs, etc.) of the fluid end, which can eventually cause the fluid end of the frac pump to fail. Failure of the fluid end of a frac pump can have relatively devastating repercussions and/or can be relatively costly.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a fluid delivery device for a hydraulic fracturing system includes a fluid conduit having a fracking fluid outlet configured to be fluidly connected to a well head for delivering a fracking fluid to the well head. The fluid conduit includes a base fluid inlet configured to be fluidly connected to the outlet of a frac pump such that the fluid conduit is configured to receive a flow of base fluid from the frac pump through the base fluid inlet. An injection system is fluidly connected to the fluid conduit downstream from the base fluid inlet and upstream from the fracking fluid outlet. The injection system is configured to be fluidly connected to a material source. The injection system is configured to inject at least one material of the fracking fluid from the material source into the fluid conduit downstream from the frac pump to generate the fracking fluid within the fluid conduit.

In some embodiments, the fluid conduit alternates between a lower-pressure state wherein the injection system draws the at least one material of the fracking fluid into the fluid conduit from the material source and a higher-pressure state wherein the fluid conduit delivers the fracking fluid to the well head.

In one embodiment, the injection system includes a material inlet fluidly connected to the fluid conduit downstream from the base fluid inlet and configured to be fluidly connected to a source of the at least one material. The material inlet includes a material inlet valve. The injection system further includes a base fluid outlet fluidly connected to the fluid conduit downstream from the material inlet and configured to be fluidly connected to an inlet of the frac pump. The base fluid outlet includes a base fluid outlet valve. The injection system is configured to draw the at least one material of the fracking fluid into the fluid conduit from the material source when the material inlet valve and the base fluid outlet valve are open.

In some embodiments, the injection system includes a material inlet valve and a base fluid outlet valve. The fluid conduit includes a base fluid inlet valve and a fracking fluid outlet valve. The injection system is configured to draw the at least one material of the fracking fluid into the fluid conduit when the material inlet valve and the base fluid outlet valve are open and the base fluid inlet valve and the fracking fluid outlet valve are closed. The fluid conduit is configured to deliver the fracking fluid to the well head when the material inlet valve and the base fluid outlet valve are closed and the base fluid inlet valve and the fracking fluid outlet valve are open.

In some embodiments, the fluid conduit is a first fluid conduit and the injection system is a first injection system. The fluid delivery device further includes second and third fluid conduits and second and third injection systems fluidly connected to the second and third fluid conduits, respectively. The second and third injection systems are configured to inject the at least one material of the fracking fluid into the second and third fluid conduits downstream from the frac pump.

In one embodiment, the injection system includes a syringe.

In some embodiments, the injection system includes a syringe having a material chamber fluidly connected to the fluid conduit downstream from the frac pump. The material chamber is configured to be fluidly connected to the material source. The syringe includes a piston that is configured to retract to draw the at least one material of the fracking fluid into the material chamber from the material source. The piston is configured to extend to push the at least one material of the fracking fluid from the material chamber into the fluid conduit downstream from the frac pump.

In some embodiments, the injection system includes a syringe having a piston, an actuator, and a base fluid chamber. The base fluid chamber is configured to be fluidly connected to the outlet of the frac pump. The actuator is configured to retract the piston. The base fluid chamber includes a base fluid inlet valve configured to open such that base fluid pressure from the outlet of the frac pump extends the piston.

In some embodiments, the injection system comprises a base fluid outlet that is configured to be fluidly connected to an inlet of the frac pump.

In a second aspect, a method for operating a hydraulic fracturing system includes pumping base fluid from the outlet of a frac pump into a fluid conduit, injecting at least one material of a fracking fluid into the fluid conduit downstream from the frac pump to generate the fracking fluid within the fluid conduit, and pumping the fracking fluid from the fluid conduit into a well head.

In some embodiments, injecting the at least one material of the fracking fluid into the fluid conduit includes closing a base fluid inlet valve at a base fluid inlet of the fluid conduit that is fluidly connected to an outlet of the frac pump, and opening a base fluid outlet valve at a base fluid outlet of the fluid conduit that is fluidly connected to an inlet of the frac pump.

In some embodiments, pumping the fracking fluid from the fluid conduit into the well head includes closing a base fluid outlet valve at a base fluid outlet of the fluid conduit that is fluidly connected to an inlet of the frac pump, and opening a base fluid inlet valve at a base fluid inlet of the fluid conduit that is fluidly connected to an outlet of the frac pump.

In one embodiment, injecting the at least one material of the fracking fluid into the fluid conduit includes injecting the at least one material into the fluid conduit from a material chamber of a syringe that is fluidly connected to the fluid conduit downstream from the frac pump.

In some embodiments, injecting the at least one material of the fracking fluid into the fluid conduit includes extending a piston of a syringe to push the at least one material from the syringe into the fluid conduit downstream from the frac pump.

In one embodiment, injecting the at least one material of the fracking fluid into the fluid conduit includes creating a lower-pressure state within the fluid conduit to draw the at least one material into the fluid conduit from a material source, and pumping the fracking fluid from the fluid conduit into the well head includes creating a higher-pressure state within the fluid conduit to push the fracking fluid from the fluid conduit into the well head.

In a third aspect, a hydraulic fracturing system includes a material source, a frac pump having a pump outlet and a pump inlet, and a fluid conduit having a fracking fluid outlet configured to be fluidly connected to a well head for delivering a fracking fluid to the well head. The fluid conduit includes a base fluid inlet fluidly connected to the pump outlet of the frac pump such that the fluid conduit is configured to receive a flow of base fluid from the frac pump through the base fluid inlet. An injection system is fluidly connected to the material source for receiving a flow of at least one material of the fracking fluid from the material source. The injection system is fluidly connected to the fluid conduit downstream from the base fluid inlet and upstream from the fracking fluid outlet. The injection system is configured to inject the at least one material of the fracking fluid into the fluid conduit downstream from the frac pump.

In some embodiments, the fluid conduit alternates between a lower-pressure state wherein the injection system draws the at least one material of the fracking fluid into the fluid conduit and a higher-pressure state wherein the fluid conduit delivers the fracking fluid to the well head.

In one embodiment, the injection system includes a material inlet valve and a base fluid outlet valve, and the fluid conduit includes a base fluid inlet valve and a fracking fluid outlet valve. The injection system is configured to draw the at least one material of the fracking fluid into the fluid conduit when the material inlet valve and the base fluid outlet valve are open and the base fluid inlet valve and the fracking fluid outlet valve are closed. The fluid conduit is configured to deliver the fracking fluid to the well head when the material inlet valve and the base fluid outlet valve are closed and the base fluid inlet valve and the fracking fluid outlet valve are open.

In some embodiments, the injection system comprises a syringe.

In some embodiments, the injection system includes a syringe having a material chamber fluidly connected to the fluid conduit downstream from the frac pump. The material chamber is fluidly connected to the material source. The syringe includes a piston that is configured to retract to draw the at least one material of the fracking fluid into the material chamber from the material source. The piston is configured to extend to push the at least one material of the fracking fluid from the material chamber into the fluid conduit downstream from the frac pump.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

Corresponding reference characters indicate corresponding parts throughout the drawings.

DETAILED DESCRIPTION

Certain embodiments of the disclosure provide a fluid delivery system that injects at least one material of a fracking fluid into a fluid conduit downstream from a frac pump 104. Certain embodiments of the disclosure provide a method for operating a hydraulic fracturing system that includes injecting at least one material of a fracking fluid into a fluid conduit downstream of a frac pump.

Certain embodiments of the disclosure can drastically mitigate the amount of relatively abrasive material that flows through the fluid end of a frac pump by introducing relatively abrasive material into a hydraulic fracturing system after the fluid end of a frac pump. In some examples, the fluid end of a frac pump will pump a relatively non-abrasive base fluid (e.g., water) exclusively. Certain embodiments of the disclosure reduce wear and erosion on the interior surfaces (e.g., the various internal passages, etc.) and/or the internal components (e.g., valves, seats, springs, etc.) of the fluid end of a frac pump. Certain embodiments of the present disclosure increase (i.e., extend) the longevity and thus the operational life of the fluid ends of frac pumps.

The fluid delivery systems and the operational methods disclosed by certain embodiments herein that introduce relatively abrasive materials of a fracking fluid after the fluid end of a frac pump can provide numerous benefits over conventional systems used for hydraulic fracturing, for example the following benefits, without limitation: a fluid end of a frac pump that wears significantly less due to the lack of relatively abrasive material flowing through the fluid end; internal surfaces and/or components of a fluid end that wear significantly less due to the lack of relatively abrasive material flowing through the fluid end; gates of a hydraulic fracturing system will take on significant wear instead of the fluid end of a frac pump; and the fluid end of a frac pump will resist failure for a longer period of time.

Figure 1:
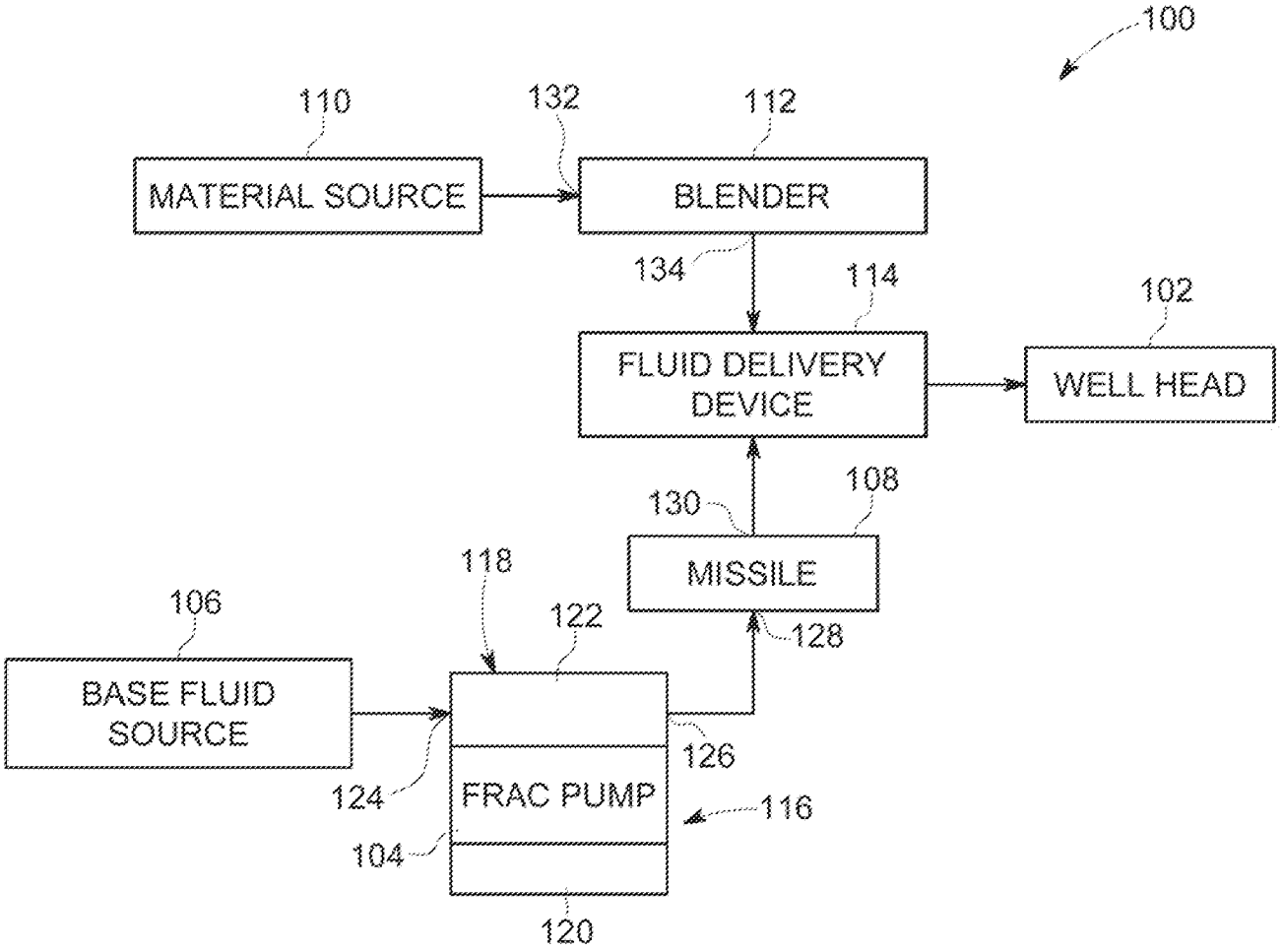
FIG. 1 is a schematic diagram of a hydraulic fracturing system according to an exemplary embodiment.

FIG. 1 is a schematic diagram of a hydraulic fracturing system 100 according to an exemplary embodiment. The hydraulic fracturing system 100 is used to pump a fracking fluid into the well head 102 of a wellbore (not shown) for performing a fracturing operation, for example fracturing a subterranean formation to drill for oil or natural gas, cementing the wellbore, treating the wellbore and/or formation, etc. The hydraulic fracturing system 100 includes a frac pump 104, one or more base fluid sources 106, an optional missile 108, one or more material sources 110, a blender 112, and a fluid delivery device 114. Although only one is shown in FIG. 1, the hydraulic fracturing system 100 can include any number of the fluid delivery devices 114.

The base fluid source 106 includes a tank, reservoir, and/or other container that holds a base fluid of the fracking fluid. As will be described below, the base fluid is mixed with one or more other materials to form the fracking fluid. The base fluid of the base fluid source 106 can be any fluid that is relatively non-abrasive, for example, water, liquefied petroleum gas (LPG), propane, and/or the like. In some examples, the base fluid is relatively non-corrosive. Although only one is shown in FIG. 1, the hydraulic fracturing system 100 can include any number of the base fluid sources 106. According to some embodiments, one or more of the base fluid sources 106 is freestanding on the ground, mounted to a trailer for towing between operational sites, mounted to a skid, loaded on a manifold, otherwise transported, and/or the like.

The frac pump 104 includes a power end portion 116 and a fluid end portion 118 operably coupled thereto. The power end portion 116 includes a crankshaft (not shown) that is driven by an engine or motor 120. The fluid end portion 118 includes a fluid end block or fluid cylinder 122 that includes an inlet 124 fluidly connected to the base fluid source 106 and an outlet 126 fluidly connected to the fluid delivery device 114 (e.g., via the missile 108 as described below). In operation, the engine or motor 120 turns the crankshaft, which reciprocates a plunger rod assembly (not shown) between the power end portion 116 and the fluid end portion 118 to thereby pump (i.e., move) a flow of the base fluid from the base fluid source 106 into the inlet 124, through the fluid cylinder 122, and out the outlet 126 to the fluid delivery device 114 (e.g., via the missile 108 as described below). Thus, the inlet 124 defines a lower-pressure side of the frac pump 104 while the outlet 126 defines a higher-pressure side of the frac pump 104. In some examples, the frac pump 104 is freestanding on the ground, mounted to a trailer for towing between operational sites, mounted to a skid, loaded on a manifold, otherwise transported, and/or the like. Although only a single frac pump 104 is shown in FIG. 1, the hydraulic fracturing system 100 can include any number of frac pumps 104.

The missile 108 is a fluid manifold that is fluidly connected between the frac pump 104 and the fluid delivery device 114 for delivering the base fluid from the frac pump 104 to the fluid delivery device 114. More particularly, the missile 108 includes an inlet 128 fluidly connected to the outlet 126 of the frac pump 104 and an outlet 130 fluidly connected to the fluid delivery device 114. The missile 108 can be freestanding on the ground, mounted to a trailer for towing between operational sites, mounted to a skid, loaded on a manifold, otherwise transported, and/or the like. Optionally, the missile 108 returns fracking fluid that has been pumped into the wellbore by the hydraulic fracturing system 100 to a tank, reservoir, and/or other container (e.g., the base fluid source 106) and/or the frac pump 104. For example, a lower-pressure side of the missile 108 can fluidly connected to the inlet 124 of the frac pump 104.

As described above, the missile 108 is an optional component of the hydraulic fracturing system 100. Accordingly, in some embodiments one or more frac pumps 104 is directly fluidly connected to a corresponding fluid delivery device 114. More particularly, the outlet 126 of a frac pump 104 of the hydraulic fracturing system 100 can be directly fluidly connected to a corresponding fluid delivery device 1114 to thereby pump (i.e., move) a flow of the base fluid through the fluid cylinder 122 and out the outlet 126 of the frac pump 104 directly to the fluid delivery device 114.

The material source 110 includes a tank, reservoir, and/or other container that holds one or more materials that are mixed with the base fluid to form the fracking fluid that is delivered to the well head 102 by the hydraulic fracturing system 100. The material(s) held by the material source 110 can include any material(s) that can be mixed with the base fluid to form a fracking fluid that is suitable for performing a fracturing operation, for example a slurry, sand, acid, proppant, a sand and base fluid mixture, a gel, a foam, a compressed gas, and/or the like. The hydraulic fracturing system 100 can include any number of the material sources 110, each of which can hold any number of different materials. According to some embodiments, one or more of the material sources 110 is freestanding on the ground, mounted to a trailer for towing between operational sites, mounted to a skid, loaded on a manifold, otherwise transported, and/or the like.

The blender 112 is configured to deliver a flow of one or more materials from the material source(s) 110 to the fluid delivery device 110. More particularly, the blender 112 includes an inlet 132 fluidly connected to the material source(s) 110 and an outlet 134 fluidly connected to the fluid delivery device 114. The blender 112 can mix two or more materials from two or more different material sources 110 together for delivery to the fluid delivery device 114. In some examples, the blender 112 is fluidly connected to a base fluid source 108 or another source of base fluid for mixing base fluid with one or more materials from one or more material sources 110 for delivery to the fluid delivery device 114. Moreover, in some examples the blender 112 mixes base fluid (whether from the base fluid source 108 or another source) with one or more materials from one or more different material sources 110 to form a finished (i.e., complete) fracking fluid that is ready for delivery to the fluid delivery device 114. Optionally, the blender 112 includes a pump (not shown) and/or other device for delivering the flow of material(s) to the fluid delivery device 114.

The blender 112 can be freestanding on the ground, mounted to a trailer for towing between operational sites, mounted to a skid, loaded on a manifold, otherwise transported, and/or the like. The hydraulic fracturing system 100 can include any number of blenders 112. The blender 112 and the material source 110 may each be referred to herein as a "material source". For example, the "material source" recited in the claims of the present disclosure may refer to the blender 112 and/or one or more material sources 110.

Figure 2:
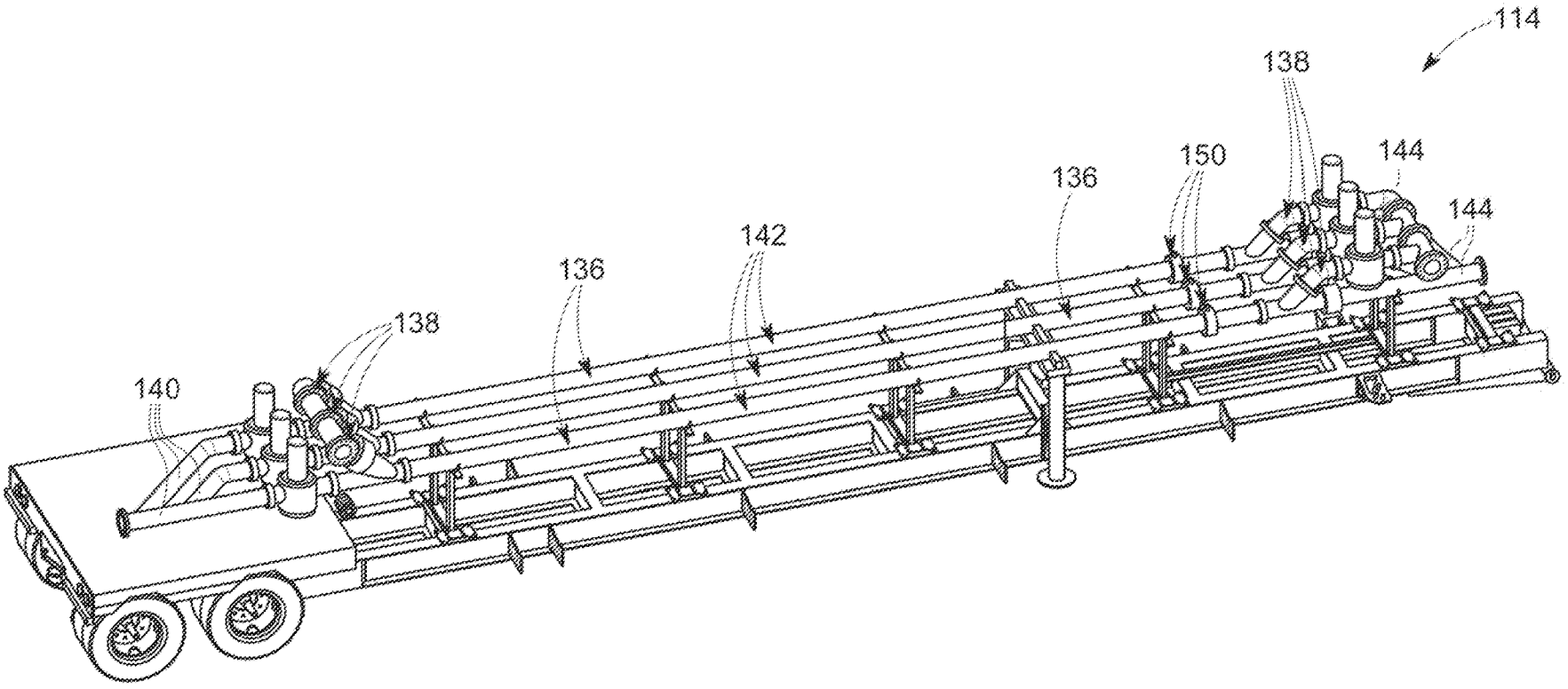
FIG. 2 is a perspective view of a fluid delivery device of the hydraulic fracturing system shown in FIG. 1 according to an exemplary embodiment.

Referring now to FIG. 2, an exemplary embodiment of the fluid delivery device 114 will now be described. The fluid delivery device 114 includes one or more fluid conduits 136 and one or more corresponding injection systems 138. In the exemplary embodiment of the fluid delivery device 114, three fluid conduits 136 and three corresponding injection systems 138 are provided. But, the fluid delivery device 114 can include any number of fluid conduits 136 and corresponding injection systems 138. Although shown in FIG. 2 as being mounted on a trailer, additionally or alternatively the fluid delivery device 114 can be freestanding on the ground, mounted to a skid, loaded on a manifold, otherwise transported, and/or the like.

Each fluid conduit 136 includes a base fluid inlet 140, a mixing segment 142, and a fracking fluid outlet 144. The base fluid inlet 140 is configured to be fluidly connected to the outlet 126 (FIGS. 1 and 5) of the frac pump 104 (FIGS. 1 and 5) for receiving the flow of base fluid from the frac pump 104. The base fluid inlet 140 defines a higher-pressure inlet of the fluid conduit 136 that receives the flow of base fluid from the higher-pressure side (i.e., the outlet 126) of the frac pump 104. Although shown as being indirectly fluidly connected to the outlet 126 of the frac pump 104 via the missile 108 (FIG. 1), as described above the base fluid inlet 140 of the fluid conduit 126 can be directly fluidly connected to the outlet 126 of the frac pump 104.

As will be described below, the injection system 138 is configured to inject at least one material of the fracking fluid (e.g., from the blender 112 shown in FIGS. 1 and 5, directly from one or more material sources 110 shown in FIG. 1, etc.) into the mixing segment 142 of the fluid conduit 136 to generate the fracking fluid within the mixing segment 142. The fracking fluid outlet 144 is configured to be fluidly connected to the well head 102 (FIGS. 1 and 5) for delivering a flow of the fracking fluid to the well head 102. The fracking fluid outlet 144 defines a higher-pressure outlet of the fluid conduit 136.

Figure 3:
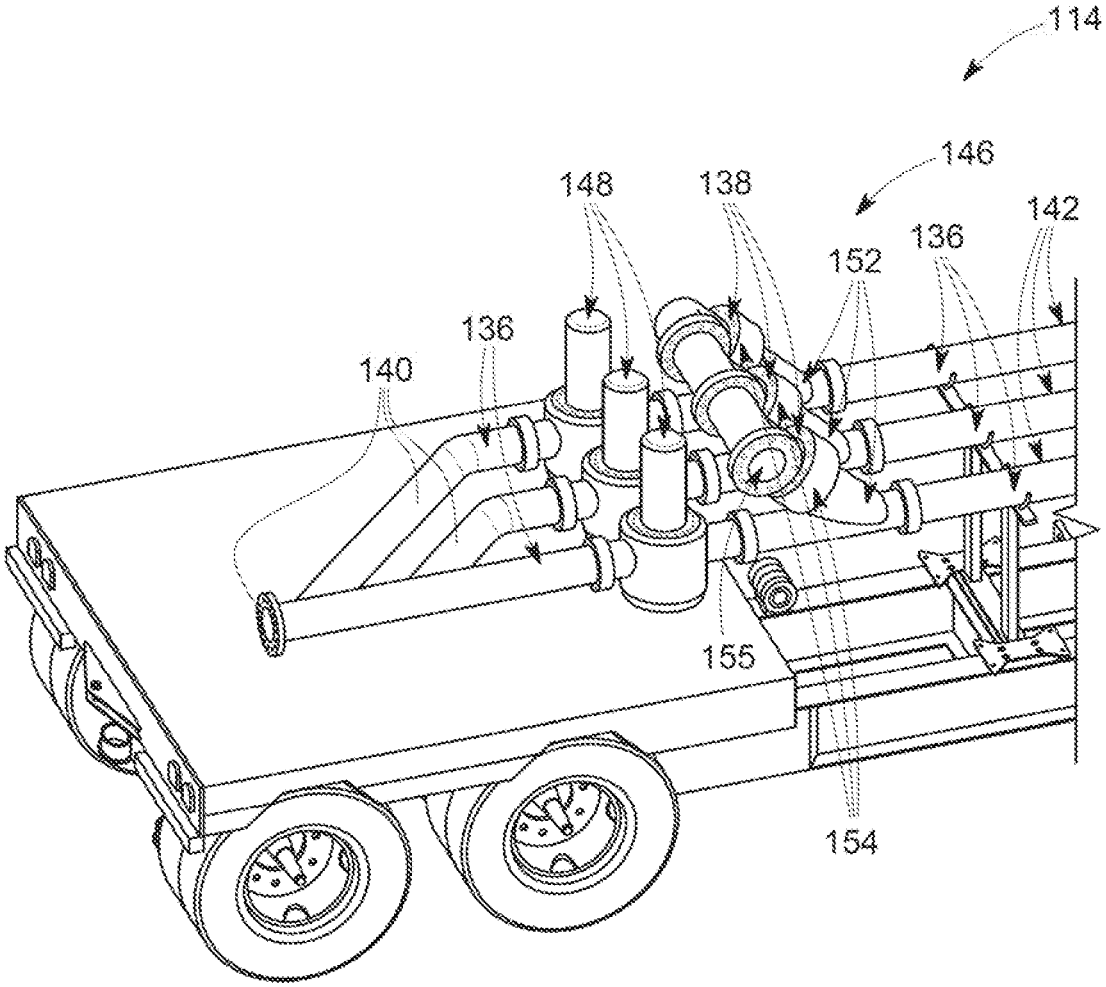
FIG. 3 is an enlarged perspective view of a portion of the fluid delivery device shown in FIG. 2 illustrating an inlet segment of the fluid delivery device according to an exemplary embodiment.

FIG. 3 illustrates an inlet side 146 of the fluid delivery device 114. The inlet side 146 includes the base fluid inlet 140 of the fluid conduit 136 and a base fluid inlet valve 148. The base fluid inlet valve 148 controls the flow of base fluid into the base fluid inlet 140 of the fluid conduit 136. More particularly, the base fluid inlet valve 148 is moveable between an open position (shown in FIG. 5) that enables base fluid to flow from the frac pump 104 (FIGS. 1 and 5) into the mixing segment 142 of the fluid conduit 136 through the base fluid inlet 140 and a closed position (shown in FIG. 5) that prevents base fluid from the frac pump 104 from flowing through the base fluid inlet 140 into the mixing segment 142. The base fluid inlet valve 148 thus provides an isolation valve on the higher-pressure inlet of the fluid conduit 136.

Figure 4:
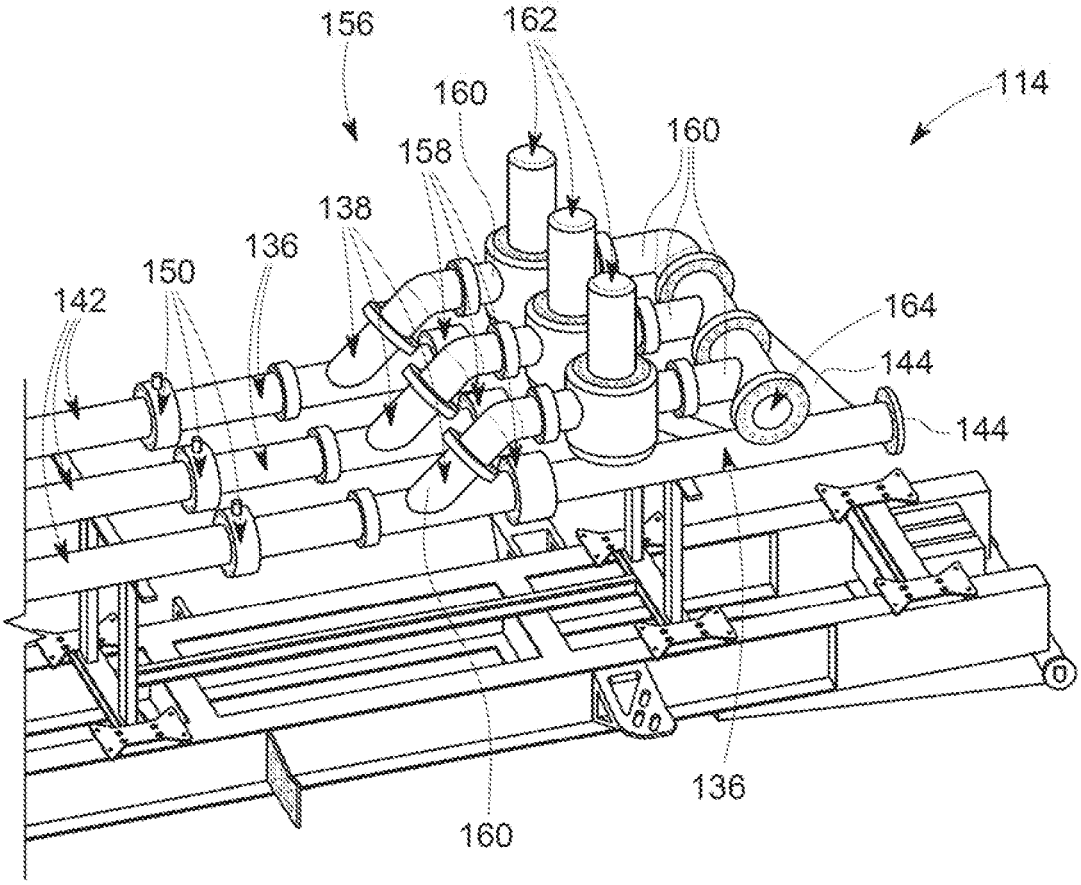
FIG. 4 is an enlarged perspective view of a portion of the fluid delivery device shown in FIG. 2 illustrating an outlet segment of the fluid delivery device according to an exemplary embodiment.
Figure 5:
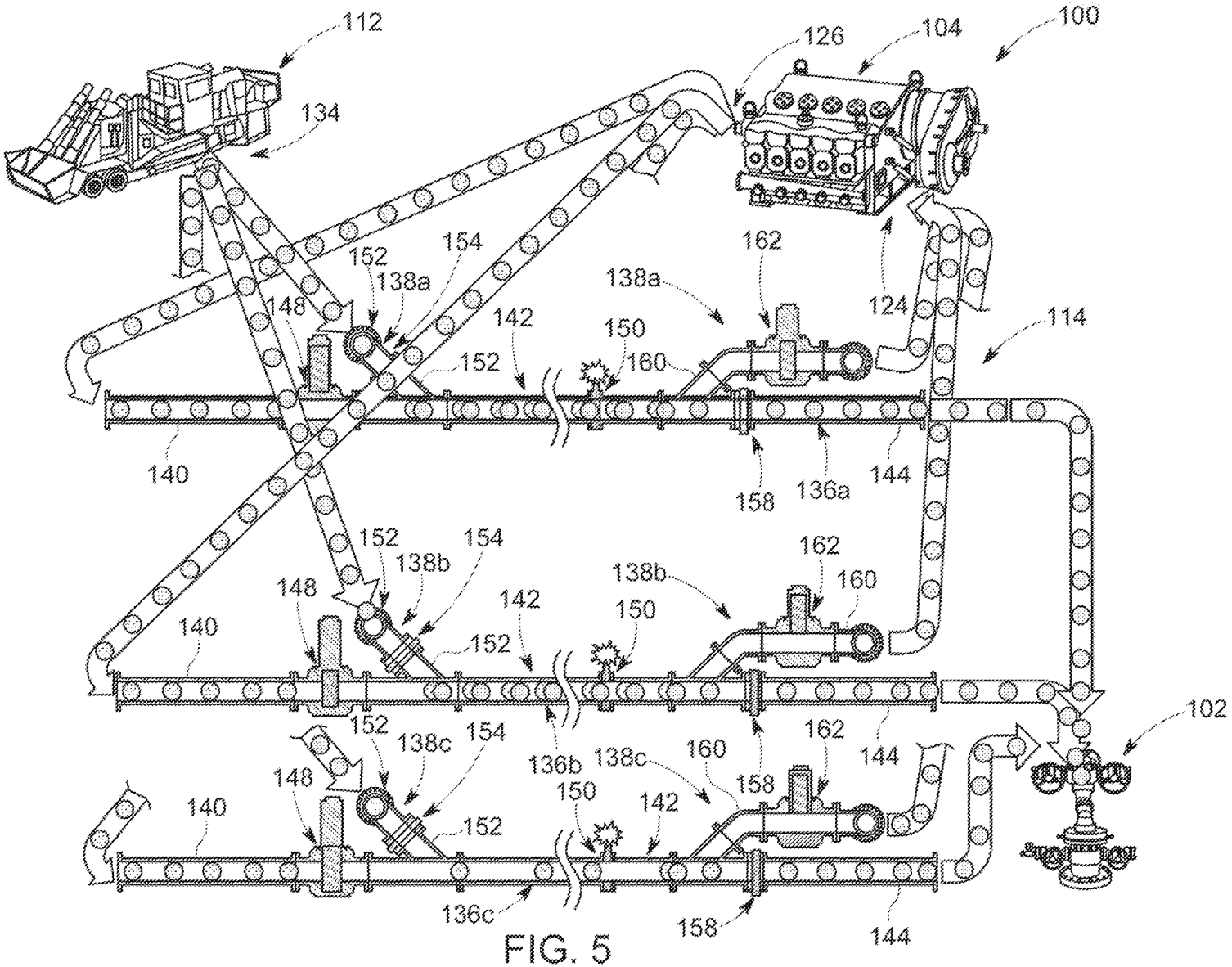
FIG. 5 is a schematic diagram of a portion of the hydraulic fracturing system shown in FIG. 1.

Movement of the base fluid inlet valve 148 between the open and closed positions is controlled by a suitable control system (not shown) of the hydraulic fracturing system 100 (FIGS. 1 and 5). In some examples, movement of the base fluid inlet valve 148 between the open and closed positions is based on a particle count sensor 150 (shown in FIGS. 2, 4, and 5) of the mixing segment 142 of the fluid conduit 136, as will be described below. In other examples, the base fluid inlet valve 148 is moved between the open and closed positions based on a predetermined timing scheme. In the exemplary embodiment of the fluid delivery device 114, the base fluid inlet valve 148 is a plug valve. But, additionally or alternatively the base fluid inlet valve 148 can include any other type of valve that enables the hydraulic fracturing system 100 to function as described and/or illustrated herein.

Each injection system 138 includes a material inlet 152 that is fluidly connected to the mixing segment 142 of the fluid conduit 136. Accordingly, the material inlet 152 is fluidly connected to the fluid conduit 136 downstream from the base fluid inlet 140 and thus downstream from the frac pump 104, as is shown herein. The material inlet 152 is configured to be fluidly connected to the outlet 134 (FIGS. 1 and 5) of the blender 112 (FIGS. 1 and 5) for receiving a flow of at least one material of the fracking fluid from the blender 112. The material inlet 152 defines a lower-pressure inlet of the fluid conduit 136.

The material inlet 152 includes a material inlet valve 154 that controls the flow of material(s) from the blender 112 through the material inlet 152 into the mixing segment 142 of the fluid conduit 136. Specifically, the material inlet valve 154 is moveable between an open position and a closed position. The open position of the material inlet valve 154 enables material(s) to flow from the blender 112 through the material inlet 152 into the mixing segment 142 of the fluid conduit 136. The closed position of the material inlet valve 154 prevents material(s) from the blender 112 from flowing through the material inlet 152 into the mixing segment 142 of the fluid conduit 136.

In the exemplary embodiment of the fluid delivery device 114, the material inlet valve 154 is a check valve that is moved between the open and closed positions via pressure differentials across the valve 154, as will be described below. In other examples, movement of the material inlet valve 154 between the open and closed positions is controlled by the control system of the hydraulic fracturing system 100 (e.g., based on the particle count sensor 150, based on a predetermined timing scheme, etc.). In addition or alternatively to a check valve, the material inlet valve 154 can include any other type of valve that enables the hydraulic fracturing system 100 to function as described and/or illustrated herein.

In the exemplary embodiment of the fluid delivery device 114, the material inlets 152 are shown in FIG. 3 as including a common entrance 155 for fluid connection with the material source(s) 110 (e.g., via the blender 112). But, in other examples one or more of the material inlets 152 can include a dedicated entrance for a separate fluid connection with the material source(s) 110 (e.g., via the blender 112).

Although shown in FIG. 5 as being indirectly fluidly connected to the material source(s) 110 via the blender 112, the material inlet 152 of a fluid conduit 136 can be directly fluidly connected to one or more of the material sources 110 for receiving a flow of at least one material of the fracking fluid directly therefrom. In some examples, the hydraulic fracturing system 100 does not include a blender 112.

FIG. 4 illustrates an outlet side 156 of the fluid delivery device 114. The outlet side 156 includes the fracking fluid outlet 144 of the fluid conduit 136. The fracking fluid outlet 144 includes a fracking fluid outlet valve 158 that controls the flow of the fracking fluid out of the fracking fluid outlet 144 to the well head 102 (FIGS. 1 and 5). The fracking fluid outlet valve 158 is moveable between an open position and a closed position. The closed position of the fracking fluid outlet valve 158 prevents fluid (e.g., base fluid, the fracking fluid, etc.) from flowing from the mixing segment 142 out to the well head 102 through the fracking fluid outlet 144. The open position of the fracking fluid outlet valve 158 enables the fracking fluid to flow from mixing segment 142 through the fracking fluid outlet 144 into the well head 102.

The exemplary embodiment of the fracking fluid outlet valve 158 is a check valve that is moved between the open and closed positions via pressure differentials across the valve 158, as will be described below. In other examples, movement of the fracking fluid outlet valve 158 between the open and closed positions is controlled by the control system of the hydraulic fracturing system 100 (e.g., based on the particle count sensor 150, based on a predetermined timing scheme, etc.). In addition or alternatively to a check valve, the fracking fluid outlet valve 158 can include any other type of valve that enables the hydraulic fracturing system 100 to function as described and/or illustrated herein.

Each injection system 138 includes a base fluid outlet 160 that is fluidly connected to the mixing segment 142 of the fluid conduit 136 downstream from the material inlet 152 (FIGS. 3 and 5). The base fluid outlet 160 is configured to be fluidly connected to the inlet 124 (FIGS. 1 and 5) of the frac pump 104 (FIGS. 1 and 5) for discharging base fluid from the mixing segment 142 of the fluid conduit 136. The base fluid outlet 160 defines a lower-pressure outlet of the fluid conduit 136.

Although shown in FIG. 5 as being directly fluidly connected to the inlet 124 of the frac pump 104, the base fluid outlet 160 of a fluid conduit 136 can be directly fluidly connected to one or more base fluid sources 106 (FIG. 1) to thereby indirectly fluidly connect the base fluid outlet 160 to the inlet 124 of the frac pump 104.

Referring again to FIG. 4, the base fluid outlet 160 includes a base fluid outlet valve 162 that controls the flow of base fluid out of the mixing segment 142 through the base fluid outlet 160. Specifically, the base fluid outlet valve 162 is moveable between an open position (shown in FIG. 5) that enables base fluid to flow out of the mixing segment 142 through the base fluid outlet 160 and a closed position (shown in FIG. 5) that prevents fluid (e.g., base fluid, the fracking fluid, etc.) from flowing out of the mixing segment 142 through the base fluid outlet 160. The base fluid outlet valve 162 thus provides an isolation valve on the lower-pressure outlet of the fluid conduit 136.

Movement of the base fluid outlet valve 162 between the open and closed positions is controlled by the control system of the hydraulic fracturing system 100 (FIGS. 1 and 5). In some examples, movement of the base fluid outlet valve 162 between the open and closed positions is based on the particle count sensor 150 of the mixing segment 142 of the fluid conduit 136, as will be described below. In other examples, the base fluid outlet valve 162 is moved between the open and closed positions based on a predetermined timing scheme. The exemplary embodiment of the base fluid outlet valve 162 is a plug valve. But, additionally or alternatively the base fluid outlet valve 162 can include any other type of valve that enables the hydraulic fracturing system 100 to function as described and/or illustrated herein.

In the exemplary embodiment of the fluid delivery device 114, the base fluid outlets 162 are shown in FIG. 4 as including a common exit 164 for fluid connection with the frac pump 104 (FIGS. 1 and 5) or the base fluid source(s) 106 (FIG. 1). But, in other examples one or more of the base fluid outlets 162 can include a dedicated exit for a separate fluid connection with the frac pump 104 and/or the base fluid source(s) 106.

Referring now to FIG. 5, operation of the fluid delivery device 114 will now be described. As described above, the exemplary embodiment of the fluid delivery device 114 includes three fluid conduits 136*a*, 136*b*, and 136*c* and three corresponding injection systems 138*a*, 138*b*, and 138*c*. Operation of the fluid conduit 136*a* and the corresponding injection system 138*a* will now be described to provide a general understanding of the operation of the fluid delivery device 114. The operation of each of the fluid conduits 136 and corresponding injections systems 138 is substantially similar such that the operational description of the fluid conduit 136*a* and the corresponding injection system 138*a* should be understood as being representative of the operation of the fluid conduits 136*b* and 136*c* and respective injection systems 138*b* and 138*c*. The combined operation of the fluid conduits 136*a*, 136*b*, and 136*c* and respective injection systems 138*a*, 138*b*, and 138*c* will be described below.

At the beginning of a cycle, an injection phase of the cycle is initiated wherein the base fluid inlet valve 148 of the base fluid inlet 140 is closed by the control system of the hydraulic fracturing system 100. The base fluid outlet valve 162 of the base fluid outlet 160 is opened to the open position by the control system of the hydraulic fracturing system 100 such that suction from the lower-pressure side of the frac pump 104 opens the material inlet valve 154 and draws one or more materials of the fracking fluid from the blender 112 into the mixing segment 142 of the fluid conduit 136*a* through the material inlet 152. In some examples, the base fluid outlet valve 162 is opened a predetermined amount of time after the base fluid inlet valve 148 is closed. In other examples, the base fluid outlet valve 162 is opened simultaneously as the base fluid inlet valve 148 is closed.

The suction of the lower-pressure side of the frac pump 104 closes the fracking fluid outlet valve 158 of the fracking fluid outlet 144 to prevent fluid contained within the mixing segment 142 from flowing out to the well head 102 through the fracking fluid outlet 144 during the injection phase of the cycle. The suction of the lower-pressure side of the frac pump 104 also draws base fluid contained within the mixing segment 142 out of the fluid conduit 136*a* through the base fluid outlet 160. Base fluid drawn out of the mixing segment 142 through the base fluid outlet 160 by the suction of the inlet 124 of the frac pump 104 is drawn into one or more of the base fluid sources 106 or directly into the inlet 124 of the frac pump 104 such that at least some base fluid is recycled during operation of the fluid deliver device 114.

In some examples, the material(s) drawn into the mixing segment 142 from the blender 112 during the injection phase of the cycle mix with base fluid remaining within the mixing segment 142 to form (i.e., generate) the fracking fluid within the mixing segment 142. In other examples, the material(s) drawn into the mixing segment 142 from the blender 112 during the injection phase of the cycle define a finished (i.e., complete) fracking fluid that is ready for delivery to the well head 102. In still other examples, the material(s) drawn into the mixing segment 142 from the blender 112 during the injection phase of the cycle mix with base fluid that is pushed into the mixing segment 142 through the base fluid inlet 140 during a delivery phase of the cycle described below to form (i.e., generate) the fracking fluid within the mixing segment 142.

Once the particle sensor 150 indicates that the mixing segment 142 of the fluid conduit 136*a* contains fracking fluid that is ready for delivery to the well head 102, the delivery phase of the cycle is initiated. For example, the particle sensor 150 can indicate that the material(s) of the fracking fluid that are mixed with base fluid to form the fracking fluid are above a predetermined number of particles (e.g., above a specific parts per million (PPM), etc.). The delivery phase of the cycle is initiated by closing the base fluid outlet valve 162 of the base fluid outlet 160 to halt suction from the lower-pressure side of the frac pump 104. The base fluid inlet valve 148 of the base fluid inlet 140 is opened to the open position to transition the mixing segment 142 of the fluid conduit 136*a* from the lower-pressure state of the injection phase of the cycle to the higher-pressure state of the delivery phase of the cycle. During the higher-pressure state of the delivery phase of the cycle, the higher-pressure side (i.e., the outlet 126) of the frac pump 104 pushes (i.e., forces) a flow of base fluid into the mixing segment 142 of the fluid conduit 136*a* through the base fluid inlet 140, which opens the fracking fluid outlet valve 158 and closes the material inlet valve 154 to thereby push (i.e., force) the fracking fluid contained within the mixing segment 142 out through the fracking fluid outlet 144 to the well head 102. Accordingly, the fracking fluid generated within the mixing segment 142 of the fluid conduit 126*a* is delivered to the well head 102 during the delivery phase of the cycle. In some examples, the base fluid inlet valve 148 is opened a predetermined amount of time after the base fluid outlet valve 162 is closed. In other examples, the base fluid inlet valve 148 is opened simultaneously as the base fluid outlet valve 162 is closed.

Once the flow of base fluid from the frac pump 104 has pushed the fracking fluid out of the mixing segment 142, the particle sensor 150 is triggered to indicate that the mixing segment 142 of the fluid conduit 136*a* contains base fluid. For example, the particle sensor 150 can indicate that the material(s) of the fracking fluid that are mixed with base fluid to form the fracking fluid are below a predetermined number of particles (e.g., below a specific parts per million (PPM), etc.). The injection phase of the cycle can then begin again to repeat the cycle of alternating the fluid conduit 136*a* between the lower-pressure state of the injection phase and the higher-pressure state of the delivery phase. As described above, a predetermined timing scheme can be used to cycle the fluid conduit 126*a* between the injection phase and the delivery phase in addition or alternative to the particle sensor 150.

As described above, the exemplary embodiment of the fluid delivery device 114 includes three fluid conduits 136 and three injection systems 138. Using two or more fluid conduits 136 and corresponding injection systems 138 (i.e., two or more fluid conduit 136 and injection system 128 pairs) and/or two or more fluid delivery devices 114 can enable the fluid delivery device(s) 114 to deliver a substantially continuous (e.g., uninterrupted) flow of fracking fluid to the well head 102 during operation of the hydraulic fracturing system 100. More particularly, the fluid conduits 136 and corresponding injection systems 138 (and/or two or more fluid delivery devices 114) can be cycled between the injection and delivery phases in an offset timing pattern during operation. For example, at all times during operation of a fluid delivery device 114: one of the fluid conduits 136 can be in the higher-pressure delivery phase; while another fluid conduit 136 is in the lower-pressure injection phase; and while yet another fluid conduit 136 is in the higher-pressure delivery phase, the lower-pressure injection phase, or is transitioning between the injection and delivery phases. The ability of the fluid delivery device(s) 114 to deliver a substantially continuous supply of the fracking fluid to the well head 102 mitigates the potential for base fluid that has not been mixed with any other materials of the fracking fluid to flow into the well head 102.

The hydraulic fracturing system 100 can include any number of the fluid delivery devices 114 (each of which can include any number of the fluid conduits 136 and corresponding injection systems 138) to facilitate delivering a substantially continuous flow of fracking fluid to the well head 102. Non-limiting examples include a fluid delivery device 114 having two, three, four, five, ten, or twenty fluid conduit 136 and injection system 138 pairs timed to deliver a substantially continuous flow of fracking fluid to the well head 102. Other non-limiting examples include two, three, four, five, ten, or twenty fluid delivery devices 114 (each of which can include any number of the fluid conduits 136 and corresponding injection systems 138) timed to deliver a substantially continuous flow of fracking fluid to the well head 102.

One example of a fluid delivery device 114 that can deliver a substantially continuous flow of fracking fluid to the well head 102 is the three-pipe fluid delivery device 114 shown in FIG. 5. More particularly, as shown in FIG. 5, the fluid conduit 136*a* is in the higher-pressure delivery phase wherein the base fluid inlet valve 148 and the fracking fluid outlet valve 158 are open and the material inlet valve 154 and the base fluid outlet valve 162 are closed. The fluid conduit 136*b* is in the lower-pressure injection phase wherein the base fluid outlet valve 162 and the material inlet valve 154 are open and the base fluid inlet valve 148 and the fracking fluid outlet valve 162 are closed. The fluid conduit 136*c* is transitioning from the higher-pressure delivery phase to the lower-pressure injection phase as indicated by the base fluid inlet valve 148 having been closed and the base fluid outlet valve 162 having been opened as a result of the mixing segment 142 of the fluid conduit 136*c* containing base fluid as is shown in FIG. 5.

Figure 6:
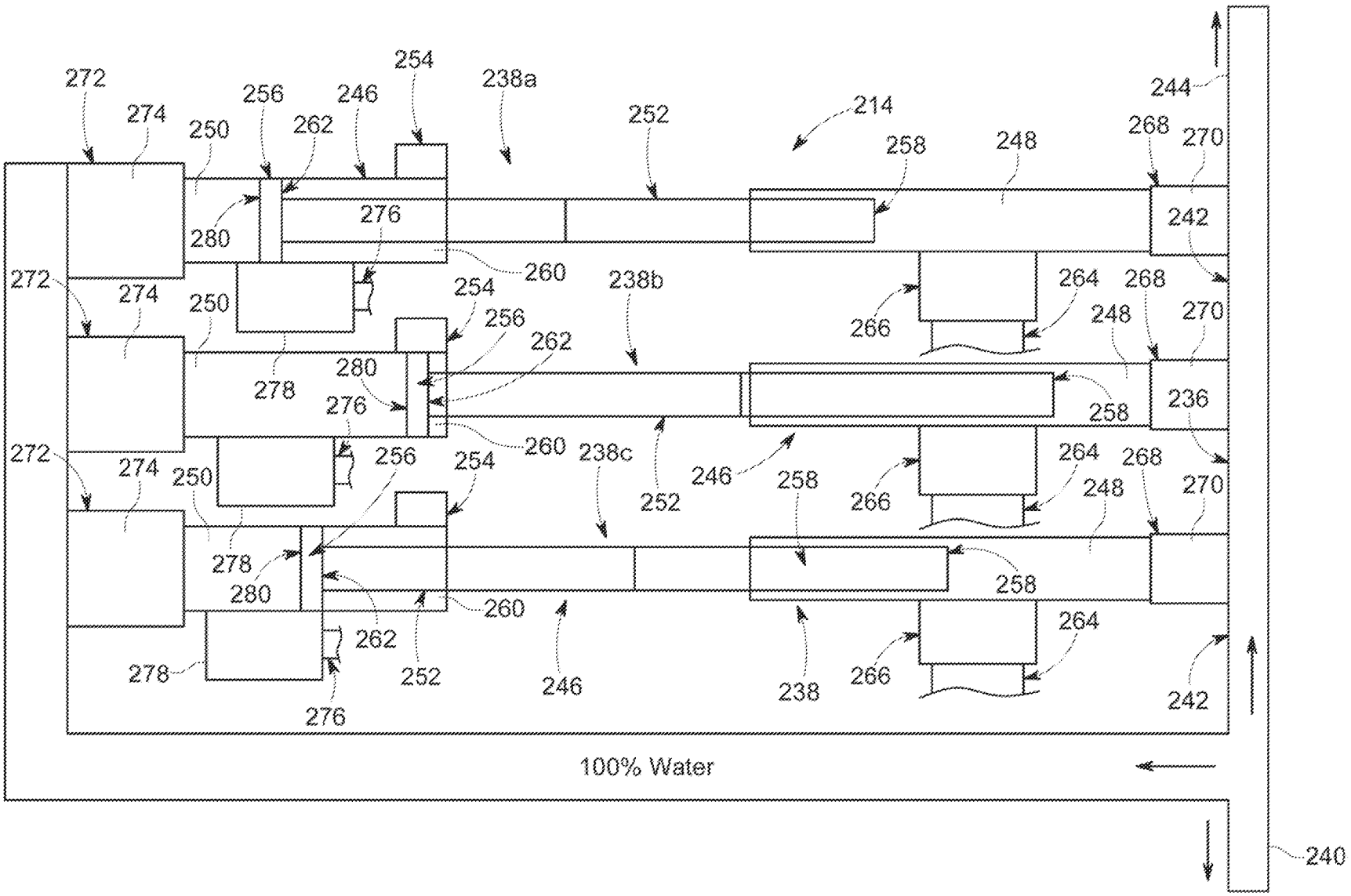
FIG. 6 is a schematic diagram of another fluid delivery device that can be used with the hydraulic fracturing system shown in FIG. 1 according to an exemplary embodiment.
Figure 7:
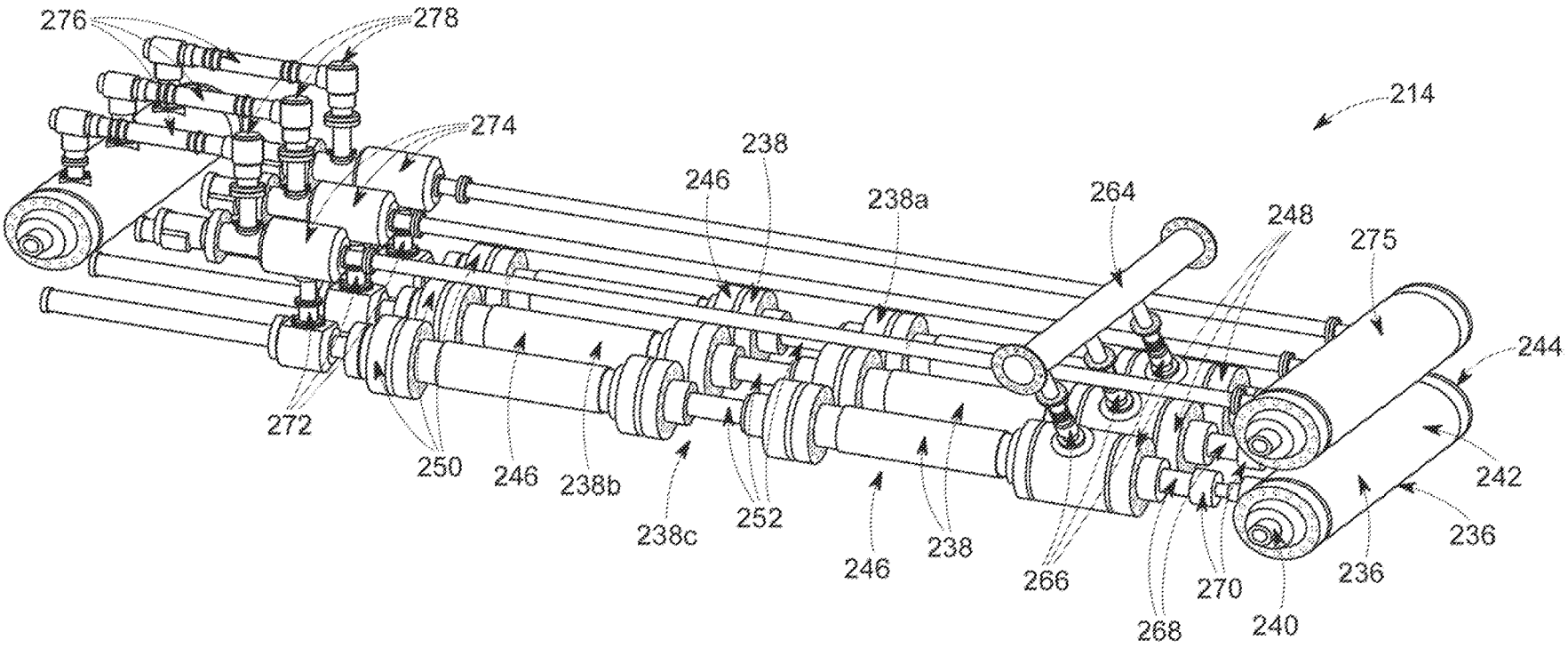
FIG. 7 is a perspective view of the fluid delivery device shown in FIG. 6.

FIG. 6 is a schematic diagram of another fluid delivery device 214 that can be used with the hydraulic fracturing system 100 (FIGS. 1 and 5) according to an exemplary embodiment. Referring now to FIGS. 6 and 7, the fluid delivery device 214 includes a fluid conduit 236 and one or more injection systems 238. In the exemplary embodiment of the fluid delivery device 214, three injection systems 238*a*, 238*b*, and 238*c* are provided. But, the fluid delivery device 214 can include any number of injection systems 238. According to some embodiments, the fluid delivery device 214 is mounted on a trailer, freestanding on the ground, mounted to a skid, loaded on a manifold, otherwise transported, and/or the like.

The fluid conduit 236 includes a base fluid inlet 240, a mixing segment 242, and a fracking fluid outlet 244. The base fluid inlet 240 is configured to be fluidly connected to the outlet 126 (FIGS. 1 and 5) of the frac pump 104 (FIGS. 1 and 5) for receiving the flow of base fluid from the frac pump 104. The base fluid inlet 240 defines a higher-pressure inlet of the fluid conduit 236 that receives the flow of base fluid from the higher-pressure side (i.e., the outlet 126) of the frac pump 104. The base fluid inlet 240 can be indirectly fluidly connected to the outlet 126 of the frac pump 104 via the missile 108 (FIG. 1) or can be directly fluidly connected to the outlet 126 of the frac pump 104.

The injection system 238 is configured to inject at least one material of the fracking fluid (e.g., from the blender 112 shown in FIGS. 1 and 5, directly from one or more material sources 110 shown in FIG. 1, etc.) into the mixing segment 242 of the fluid conduit 236 to generate the fracking fluid within the mixing segment 242. The fracking fluid outlet 244 is configured to be fluidly connected to the well head 102 (FIGS. 1 and 5) for delivering a flow of the fracking fluid to the well head 102. The fracking fluid outlet 244 defines a higher-pressure outlet of the fluid conduit 236.

Each injection system 238 includes a syringe 246 that includes a material chamber 248, a base fluid chamber 250, a piston 252, and an actuator 254 (not shown in FIG. 7). The piston 252 includes a piston head 256 (not visible in FIG. 7) that extends within the base fluid chamber 250 and a piston ram 258 (not visible in FIG. 7) that extends within the material chamber 248. The piston 252 is configured to move between an extended position and a retracted position such that the piston ram 258 extends and retracts within the material chamber 248, as can be seen in FIG. 6. For example, the piston ram 258 of the injection system 238*a* is shown in FIG. 6 in the retracted position, while the piston ram 258 of the injection system 238*b* is shown in an extended position in FIG. 6. Operation of the piston 252 will be described in more detail below.

The actuator 254 is operatively connected to the piston 252 such that the actuator 254 is configured to move the piston 252 from the extended position to the retracted position. In the exemplary embodiment of the fluid delivery device 214, the actuator 254 is a hydraulic oil pump that is configured to move hydraulic oil into a hydraulic oil chamber 260 (not shown in FIG. 7) such that the hydraulic oil exerts a force on a side 262 (not visible in FIG. 7) of the piston head 256 that moves the piston 252 from the extended position to the retracted position. The actuator 254 is not limited to being a hydraulic oil pump, but rather additionally or alternatively can include any type of actuator that is capable of moving the piston 252 from the extended position to the retracted position, for example an electric motor, a linear actuator (e.g., a ball screw, a lead screw, a rotary screw, a solenoid, etc.), and/or the like.

The material chamber 248 of the syringe 246 of each injection system 238 includes a material inlet 264 that is fluidly connected to the outlet 134 (FIGS. 1 and 5) of the blender 112 for receiving a flow of at least one material of the fracking fluid from the blender 112. The material inlet 264 includes a material inlet valve 266 that controls the flow of material(s) from the blender 112 through the material inlet 264 into the material chamber 248 of the syringe 246. Specifically, the material inlet valve 266 is moveable between an open position and a closed position. The open position of the material inlet valve 266 enables material(s) to flow from the blender 112 through the material inlet 264 into the material chamber 248. The closed position of the material inlet valve 266 prevents material(s) from the blender 112 from flowing through the material inlet 264 into the material chamber 248.

In the exemplary embodiment of the fluid delivery device 214, the material inlet valve 266 is a check valve that is moved between the open and closed positions via pressure differentials across the valve 266, as will be described below. In other examples, movement of the material inlet valve 266 between the open and closed positions is controlled by the control system of the hydraulic fracturing system 100 (e.g., based on a position of the piston ram 258, based on a predetermined timing scheme, based on a particle count sensor (not shown) within the material chamber 248, based on another sensor (not shown) within the material chamber 248, etc.). In addition or alternatively to a check valve, the material inlet valve 266 can include any other type of valve that enables the hydraulic fracturing system 100 to function as described and/or illustrated herein.

Although described herein as being indirectly fluidly connected to the material source(s) 110 via the blender 112, the material inlet 264 of the material chamber 248 of each syringe 246 can be directly fluidly connected to one or more of the material sources 110 for receiving a flow of at least one material of the fracking fluid directly therefrom. In the exemplary embodiment of the fluid delivery device 214, the material chambers 248 are shown in FIG. 7 as including a common material inlet 264, but in other examples one or more of the material chambers 248 can include a dedicated material inlet for separate fluid connection with the blender 112 and/or material source(s) 110.

The material chamber 248 of the syringe 246 of each injection system 238 includes a material outlet 268 that is fluidly connected to the mixing segment 242 of the fluid conduit 236. Accordingly, the material outlet 268 is fluidly connected to the fluid conduit 236 downstream from the base fluid inlet 240 and thus downstream from the frac pump 104, as is shown herein.

The material outlet 268 includes a material outlet valve 270 that controls the flow of material(s) from the material chamber 248 of the syringe 246 through the material outlet 268 into the mixing segment 242 of the fluid conduit 236. Specifically, the material outlet valve 270 is moveable between an open position and a closed position. The open position of the material outlet valve 270 enables material(s) to flow from the material chamber 248 through the material outlet 268 into the mixing segment 242 of the fluid conduit 236. The closed position of the material outlet valve 270 prevents material(s) from the material chamber 248 from flowing through the material outlet 268 into the mixing segment 242 of the fluid conduit 236.

In the exemplary embodiment of the fluid delivery device 214, the material outlet valve 270 is a check valve that is moved between the open and closed positions via pressure differentials across the valve 270, as will be described below. In other examples, movement of the material outlet valve 270 between the open and closed positions is controlled by the control system of the hydraulic fracturing system 100 (e.g., based on a position of the piston ram 258, based on a predetermined timing scheme, based on a particle count sensor within the material chamber 248, based on another sensor within the material chamber 248, etc.). In addition or alternatively to a check valve, the material outlet valve 270 can include any other type of valve that enables the hydraulic fracturing system 100 to function as described and/or illustrated herein.

The base fluid chamber 250 of the syringe 246 of each injection system 238 includes a base fluid inlet 272 that is configured to be fluidly connected to the outlet 126 of the frac pump 104 for receiving a flow of base fluid from the frac pump 104. The base fluid inlet 272 can be indirectly fluidly connected to the outlet 126 of the frac pump 104 via the missile 108 or can be directly fluidly connected to the outlet 126 of the frac pump 104. The base fluid inlet 272 includes a base fluid inlet valve 274. The base fluid inlet valve 274 controls the flow of base fluid into the base fluid chamber 250 of the syringe 246. More particularly, the base fluid inlet valve 274 is moveable between an open position that enables base fluid to through the base fluid inlet 272 into the base fluid chamber 250 and a closed position that prevents base fluid from the frac pump 104 from flowing through the base fluid inlet 272 into the base fluid chamber 250.

Movement of the base fluid inlet valve 274 between the open and closed positions can be controlled by the control system of the hydraulic fracturing system 100. In some examples, movement of the base fluid inlet valve 274 between the open and closed positions is based on a position of the piston head 256. In other examples, movement of the base fluid inlet valve 274 between the open and closed positions is based on a predetermined timing scheme, a particle count sensor within the material chamber 248, another sensor within the material chamber 248, and/or the like. In the exemplary embodiment of the fluid delivery device 214, the base fluid inlet valve 274 is a hydraulic fill valve. But, additionally or alternatively the base fluid inlet valve 274 can include any other type of valve (e.g., an integrated circuit (IC) driven valve, a programmable logic control (PLC) driven valve, another electrically controlled valve, etc.) that enables the hydraulic fracturing system 100 to function as described and/or illustrated herein.

In the exemplary embodiment of the fluid delivery device 214, the base fluid inlets 272 are shown in FIG. 7 as including a common entrance 275 for fluid connection with the frac pump 104 or the base fluid source(s) 106 (FIG. 1). But, in other examples one or more of the base fluid inlets 272 can include a dedicated entrance for a separate fluid connection with the frac pump 104 and/or the base fluid source(s) 106.

The base fluid chamber 250 of the syringe 246 of each injection system 238 includes a base fluid outlet 276 that is fluidly connected to one or more of the base fluid sources 106 for discharging base fluid from the base fluid chamber 250 during retraction of the piston 252. The base fluid outlet 276 includes a base fluid outlet valve 278 that controls the flow of base fluid out of the base fluid chamber 250 through the base fluid outlet 276. Specifically, the base fluid outlet valve 278 is moveable between an open position that enables base fluid to flow out of the base fluid chamber 250 through the base fluid outlet 276 and a closed position that prevents base fluid from flowing out of the base fluid chamber 250 through the base fluid outlet 276.

In some examples, movement of the base fluid outlet valve 278 between the open and closed positions is based on a pressure differential across the valve 278 (e.g., the valve 278 is a check valve). In other examples, movement of the base fluid outlet valve 278 between the open and closed positions is based on a predetermined timing scheme, a particle count sensor within the material chamber 248, another sensor within the material chamber 248, a position of the piston head 256, and/or the like. Movement of the base fluid outlet valve 278 between the open and closed positions can be controlled by the control system of the hydraulic fracturing system 100. In the exemplary embodiment of the fluid delivery device 214, the base fluid outlet valve 278 is a hydraulic bleed valve. But, additionally or alternatively the base fluid outlet valve 274 can include any other type of valve (e.g., an IC driven valve, a PLC driven valve, another electrically controlled valve, etc.) that enables the hydraulic fracturing system 100 to function as described and/or illustrated herein.

In the exemplary embodiment of the fluid delivery device 214, the base fluid outlets 276 are shown in FIG. 7 as including a common exit 277 for fluid connection with the base fluid source(s) 106. But, in other examples one or more of the base fluid outlets 276 can include a dedicated exit for a separate fluid connection with the base fluid source(s) 106.

Operation of the syringe 240 of the injection system 238*a* will now be described to provide a general understanding of the operation of the fluid delivery device 214. The operation of the syringes 240 of each of the injections systems 238 is substantially similar such that the operational description of the injection system 238*a* should be understood as being representative of the operation of the injection systems 238*b* and 238*b*.

At the beginning of a cycle, the actuator 254 moves the piston 252 to the retracted position thereby creating a lower-pressure suction that opens the material inlet valve 266 and draws one or more materials of the fracking fluid from the blender 112 into the material chamber 248 through the material inlet 264. Movement of the piston 252 toward the retracted position also opens the base fluid outlet valve 278 such that base fluid within the base fluid chamber 250 is discharged therefrom through the base fluid outlet 276. In the exemplary embodiment, the suction within the material chamber 248 and/or a bias of the material outlet valve 270 to the closed position closes (or maintains as closed) the material outlet valve 270 during retraction of the piston 252. The base fluid inlet valve 274 is also in the closed position during movement of the piston 252 toward the retracted position.

Once the piston 252 reaches a fully retracted position, the base fluid outlet valve 278 closes and the base fluid inlet valve 274 opens such that base fluid from the outlet 126 of the frac pump 104 flows into the base fluid chamber 250. The pressure exerted by the flow of base fluid on a side 280 of the piston head 256 is effectively greater than the pressure exerted on the opposite side 262 of the piston head 256 by the hydraulic oil, which causes the piston 252 to move from the retracted position to the extended position. As the piston 252 moves to the extended position, the piston ram 258 pressurizes the material(s) from the blender 112 contained within the material chamber 248 such that the material outlet valve opens 270 opens and the material(s) contained within the material chamber 248 discharge (i.e., are injected) into the mixing segment 242 through the material outlet 268 to thereby generate the fracking fluid within the mixing segment 242. In the exemplary embodiment, the pressure within the material chamber 248 and/or a bias of the material inlet valve 266 to the closed position closes the material outlet inlet valve 266 at the onset of extension of the piston 252.

Once the material(s) drawn into the material chamber 248 from the blender 112 have been discharged into the mixing segment 242 of the fluid conduit 236, the base fluid inlet valve 274 closes and the actuator 254 can retract the piston 252 to repeat the cycle of the syringe 246 drawing the material(s) from the blender 112 into the material chamber 248 and injecting the material(s) into the mixing segment 242 to generate the fracking fluid within the fluid conduit 236.

In some examples, the material(s) injected into the mixing segment 242 from the material chamber 248 mix with base fluid flowing through the mixing segment 242 to form (i.e., generate) the fracking fluid within the mixing segment 242. In other examples, the material(s) injected into the mixing segment 242 from the material chamber 248 define a finished (i.e., complete) fracking fluid that is ready for delivery to the well head 102.

Various parameters of the injection system 238 can be selected such that the effective pressure exerted on the side 280 of the piston head 256 by the base fluid is greater than the pressure exerted on the opposite side 262 by the hydraulic oil when the base fluid inlet valve 274 is open, for example the surface area of the side 280 as compared to the side 262, the pressure of the base fluid within the base fluid chamber 250 created by the frac pump 104 as compared to the resting pressure the hydraulic oil within the hydraulic oil chamber 260, and/or the like.

Using two or more injection systems 238 (and/or two or more fluid delivery devices 214) can enable the fluid delivery device(s) 214 to deliver a substantially continuous flow of fracking fluid to the well head 102 during operation of the hydraulic fracturing system 100. More particularly, the syringes 246 of the injection systems 238 (and/or two or more fluid delivery devices 214) can be cycled between injection phases in an offset timing pattern, for example as is shown in FIG. 6. The ability of the fluid delivery device(s) 214 to deliver a substantially continuous supply of the fracking fluid to the well head 102 mitigates the potential for base fluid that has not been mixed with any other materials of the fracking fluid to flow into the well head 102.

The hydraulic fracturing system 100 can include any number of the fluid delivery devices 214 (each of which can include any number of the injection systems 238) to facilitate delivering a substantially continuous flow of fracking fluid to the well head 102. Non-limiting examples include a fluid delivery device 214 having two, three, four, five, ten, or twenty injection systems 238 timed to deliver a substantially continuous flow of fracking fluid to the well head 102. Other non-limiting examples include two, three, four, five, ten, or twenty fluid delivery devices 214 (each of which can include any number of the injection systems 238) timed to deliver a substantially continuous flow of fracking fluid to the well head 102.

Figure 8:
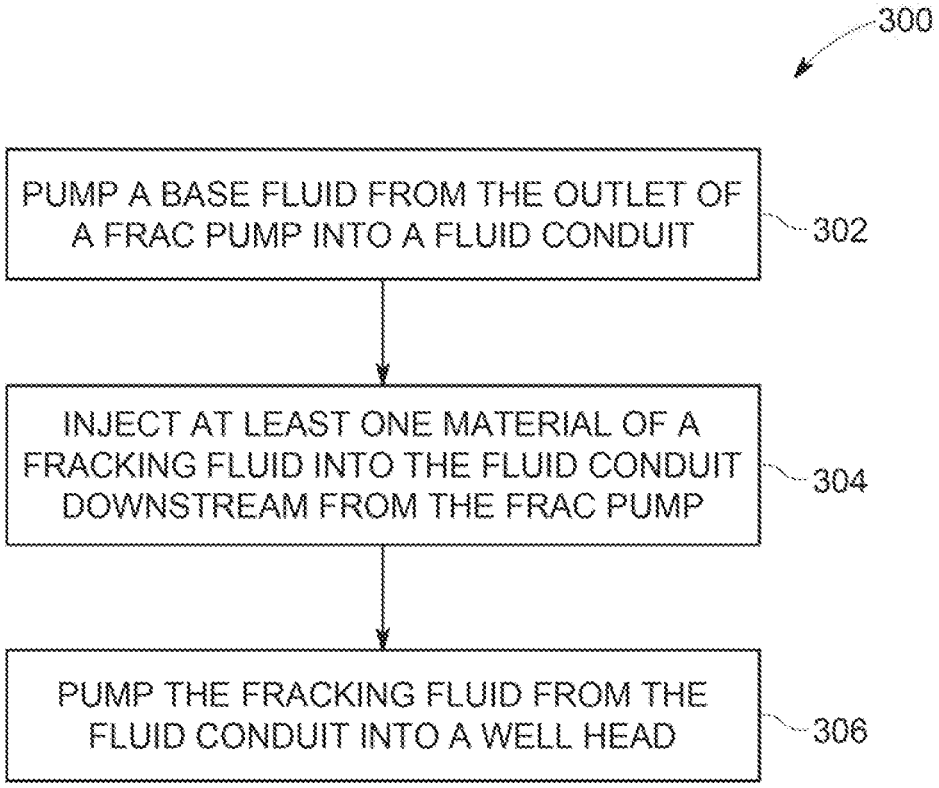
FIG. 8 is an exemplary flowchart illustrating a method for operating a hydraulic fracturing system according to an exemplary embodiment.

Referring now to FIG. 8, a method 300 for operating a hydraulic fracturing system according to an exemplary embodiment is shown. At step 302, the method 300 includes pumping a base fluid from the outlet of a frac pump into a fluid conduit. The method 300 includes injecting, at 304, at least one material of a fracking fluid into the fluid conduit downstream from the frac pump to generate the fracking fluid within the fluid conduit. At step 306, the method 300 includes pumping the fracking fluid from the fluid conduit into a well head.

The steps of the method 300 can be performed in any order. For example, injecting at 304 the at least one material of the fracking fluid into the fluid conduit can be performed before any base fluid is pumped at 302 into the fluid conduit, wherein the step of pumping at 306 the fracking fluid from the fluid conduit into the well head can include pumping at 302 the base fluid from the outlet of the frac pump into the fluid conduit.

Figure 9:
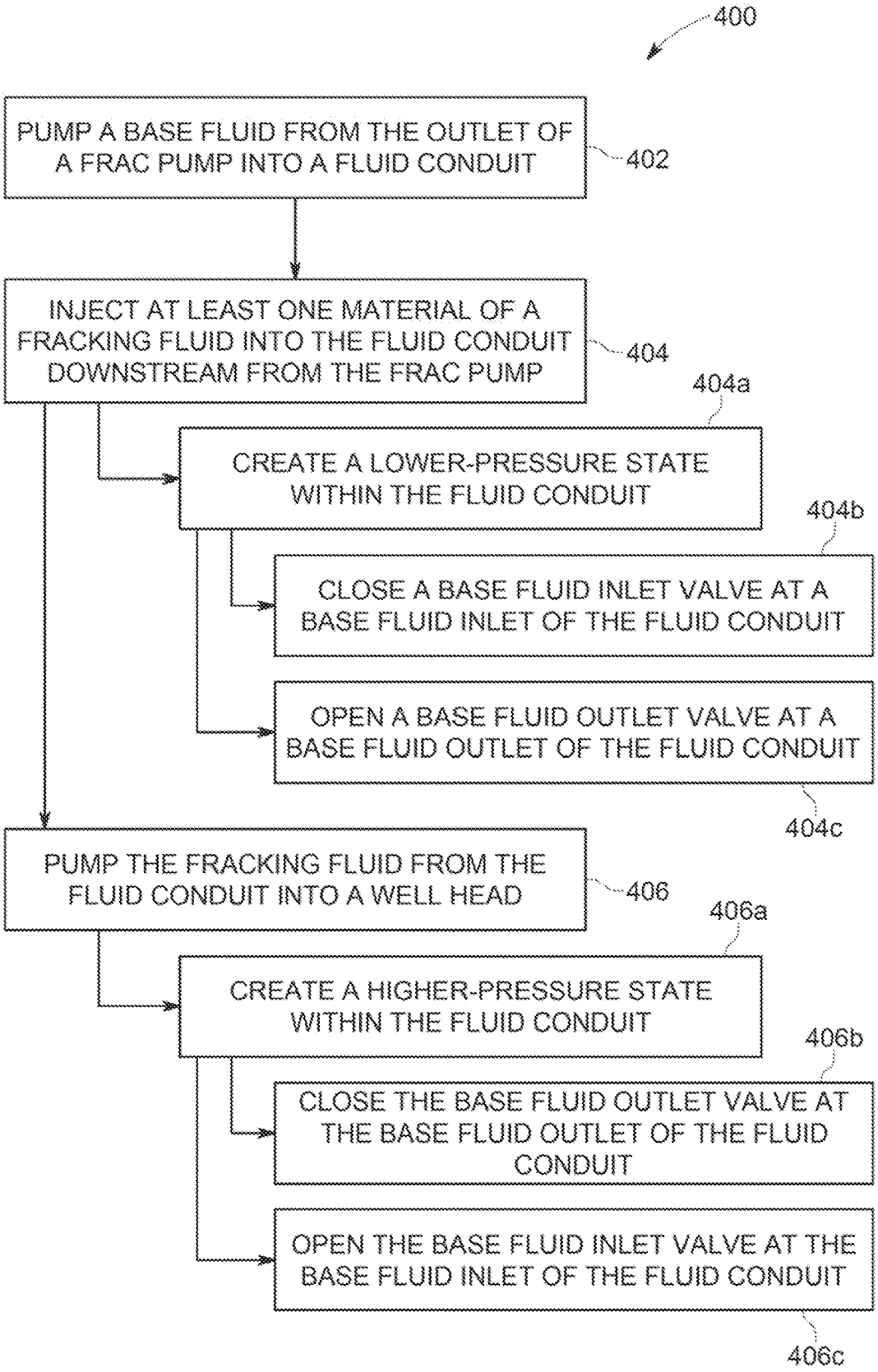
FIG. 9 is an exemplary flowchart illustrating another method for operating a hydraulic fracturing system according to an exemplary embodiment.

Referring now to FIG. 9, a method 400 for operating a hydraulic fracturing system according to an exemplary embodiment is shown. At step 402, the method 400 includes pumping a base fluid from the outlet of a frac pump into a fluid conduit. At 404, the method 400 includes injecting at least one material of a fracking fluid into the fluid conduit downstream from the frac pump to generate the fracking fluid within the fluid conduit. In some examples, injecting at 404 the at least one material of the fracking fluid into the fluid conduit includes creating, at 404*a* a lower-pressure state within the fluid conduit to draw the at least one material into the fluid conduit from a material source. For example, injecting at 404 the at least one material of the fracking fluid into the fluid conduit can include closing, at 404*b*, a base fluid inlet valve at a base fluid inlet of the fluid conduit that is fluidly connected to an outlet of the frac pump, and opening, at 404*c*, a base fluid outlet valve at a base fluid outlet of the fluid conduit that is fluidly connected to an inlet of the frac pump.

At step 406, the method 400 includes pumping the fracking fluid from the fluid conduit into a well head. In some examples, pumping at 406 the fracking fluid from the fluid conduit into a well head includes creating, at 406*a*, a higher-pressure state within the fluid conduit to push the fracking fluid from the fluid conduit into the well head. For example, pumping at 406 the fracking fluid from the fluid conduit into the well head includes can include closing, at 406*b*, the base fluid outlet valve at the base fluid outlet of the fluid conduit that is fluidly connected to an inlet of the frac pump, and opening, at 406*c*, the base fluid inlet valve at the base fluid inlet of the fluid conduit that is fluidly connected to an outlet of the frac pump.

The steps of the method 400 can be performed in any order. For example, injecting at 404 the at least one material of the fracking fluid into the fluid conduit can be performed before any base fluid is pumped at 402 into the fluid conduit, wherein the step of pumping at 406 the fracking fluid from the fluid conduit into the well head can include pumping at 402 the base fluid from the outlet of the frac pump into the fluid conduit.

Figure 10:
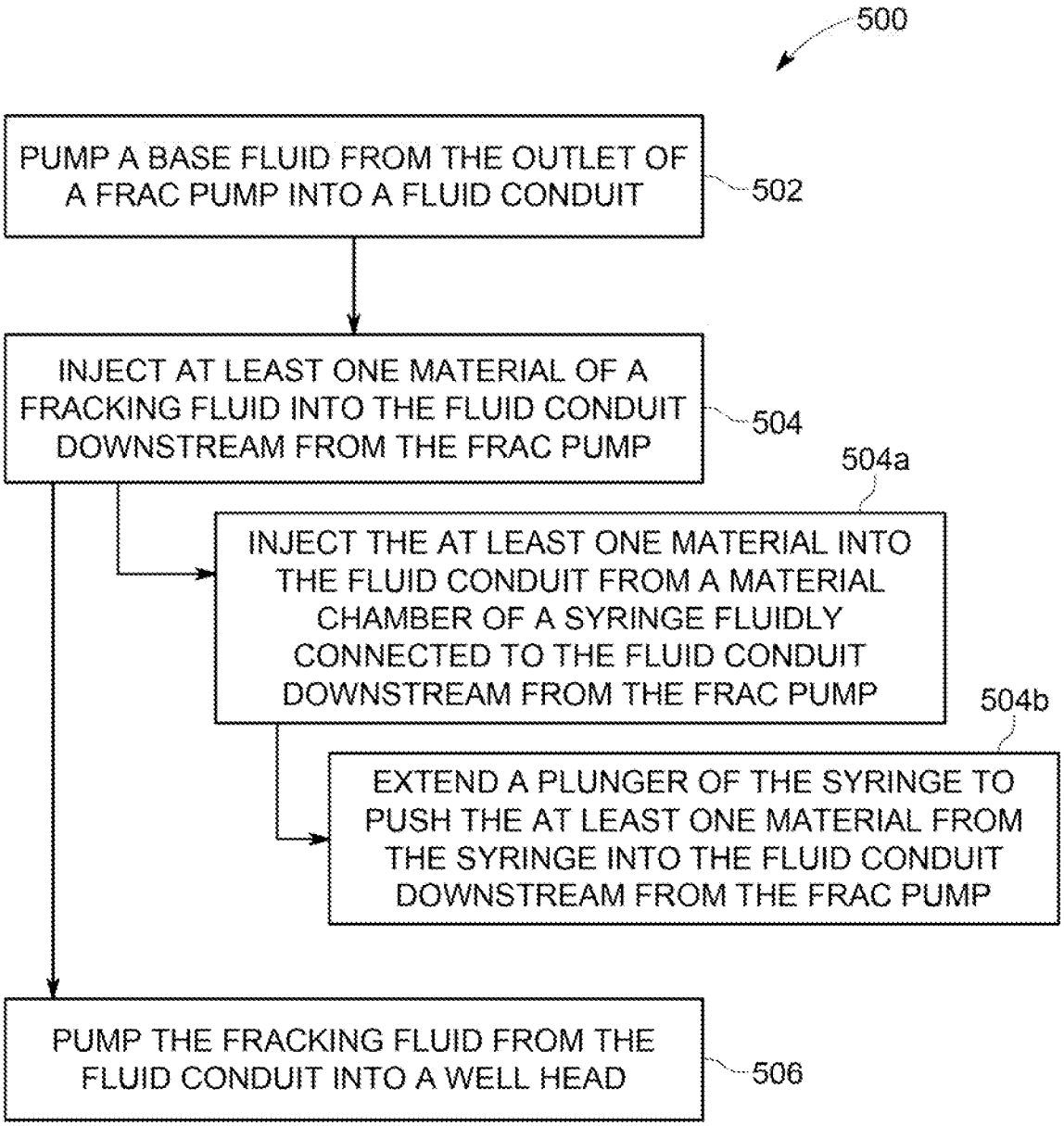
FIG. 10 is an exemplary flowchart illustrating another method for operating a hydraulic fracturing system according to an exemplary embodiment.

Referring now to FIG. 10, a method 500 for operating a hydraulic fracturing system according to an exemplary embodiment is shown. At step 502, the method 500 includes pumping a base fluid from the outlet of a frac pump into a fluid conduit. The method 500 includes injecting, at 504, at least one material of a fracking fluid into the fluid conduit downstream from the frac pump to generate the fracking fluid within the fluid conduit.

In some examples, injecting at 504 the at least one material of the fracking fluid into the fluid conduit includes injecting, at 504*a*, the at least one material into the fluid conduit from a material chamber of a syringe that is fluidly connected to the fluid conduit downstream from the frac pump. For example, injecting at 504*a* the at least one material into the fluid conduit from a material chamber of a syringe can include extending, at 504*b*, a piston of a syringe to push the at least one material from the syringe into the fluid conduit downstream from the frac pump.

At step 506, the method 500 includes pumping the fracking fluid from the fluid conduit into a well head.

The steps of the method 500 can be performed in any order. For example, injecting at 504 the at least one material of the fracking fluid into the fluid conduit can be performed before any base fluid is pumped at 502 into the fluid conduit, wherein the step of pumping at 506 the fracking fluid from the fluid conduit into the well head can include pumping at 502 the base fluid from the outlet of the frac pump into the fluid conduit.

The following clauses describe further aspects of the disclosure:

Clause Set A:

A1. A fluid delivery device for a hydraulic fracturing system, said fluid delivery device comprising:

a fluid conduit comprising a fracking fluid outlet configured to be fluidly connected to a well head for delivering a fracking fluid to the well head, the fluid conduit comprising a base fluid inlet configured to be fluidly connected to the outlet of a frac pump such that the fluid conduit is configured to receive a flow of base fluid from the frac pump through the base fluid inlet; and an injection system fluidly connected to the fluid conduit downstream from the base fluid inlet and upstream from the fracking fluid outlet, the injection system being configured to be fluidly connected to a material source, wherein the injection system is configured to inject at least one material of the fracking fluid from the material source into the fluid conduit downstream from the frac pump to generate the fracking fluid within the fluid conduit.

A2. The fluid delivery device of clause A1, wherein the fluid conduit alternates between a lower-pressure state wherein the injection system draws the at least one material of the fracking fluid into the fluid conduit from the material source and a higher-pressure state wherein the fluid conduit delivers the fracking fluid to the well head.

A3. The fluid delivery device of clause A1, wherein the injection system comprises a material inlet fluidly connected to the fluid conduit downstream from the base fluid inlet and configured to be fluidly connected to the material source, the material inlet comprising a material inlet valve, the injection system further comprising a base fluid outlet fluidly connected to the fluid conduit downstream from the material inlet and configured to be fluidly connected to an inlet of the frac pump, the base fluid outlet comprising a base fluid outlet valve, wherein the injection system is configured to draw the at least one material of the fracking fluid into the fluid conduit from the material source when the material inlet valve and the base fluid outlet valve are open.

A4. The fluid delivery device of clause A1, wherein the injection system comprises a material inlet valve and a base fluid outlet valve, the fluid conduit comprising a base fluid inlet valve and a fracking fluid outlet valve, wherein the injection system is configured to draw the at least one material of the fracking fluid into the fluid conduit when the material inlet valve and the base fluid outlet valve are open and the base fluid inlet valve and the fracking fluid outlet valve are closed, and wherein the fluid conduit is configured to deliver the fracking fluid to the well head when the material inlet valve and the base fluid outlet valve are closed and the base fluid inlet valve and the fracking fluid outlet valve are open.

A5. The fluid delivery device of clause A1, wherein the fluid conduit is a first fluid conduit and the injection system is a first injection system, the fluid delivery device further comprising second and third fluid conduits and second and third injection systems fluidly connected to the second and third fluid conduits, respectively, the second and third injection systems configured to inject the at least one material of the fracking fluid into the second and third fluid conduits downstream from the frac pump.

A6. The fluid delivery device of clause A1, wherein the injection system comprises a syringe.

A7. The fluid delivery device of clause A1, wherein the injection system comprises a syringe having a material chamber fluidly connected to the fluid conduit downstream from the frac pump, the material chamber being configured to be fluidly connected to the material source, the syringe comprising a piston that is configured to retract to draw the at least one material of the fracking fluid into the material chamber from the material source, the piston being configured to extend to push the at least one material of the fracking fluid from the material chamber into the fluid conduit downstream from the frac pump.

A8. The fluid delivery device of clause A1, wherein the injection system comprises a syringe having a piston, an actuator, and a base fluid chamber, the base fluid chamber configured to be fluidly connected to the outlet of the frac pump, the actuator being configured to retract the piston, the base fluid chamber comprising a base fluid inlet valve configured to open such that base fluid pressure from the outlet of the frac pump extends the piston.

A9. The fluid delivery device of clause A1, wherein the injection device comprises a base fluid outlet that is configured to be fluidly connected to an inlet of the frac pump.

Clause Set B:

B1. A method for operating a hydraulic fracturing system, said method comprising:

pumping base fluid from the outlet of a frac pump into a fluid conduit;

injecting at least one material of a fracking fluid into the fluid conduit downstream from the frac pump to generate the fracking fluid within the fluid conduit downstream from the frac pump; and pumping the fracking fluid from the fluid conduit into a well head.

B2. The method of clause B1, wherein injecting the at least one material of the fracking fluid into the fluid conduit comprises:

closing a base fluid inlet valve at a base fluid inlet of the fluid conduit that is fluidly connected to an outlet of the frac pump; and opening a base fluid outlet valve at a base fluid outlet of the fluid conduit that is fluidly connected to an inlet of the frac pump.

B3. The method of clause B 1, wherein pumping the fracking fluid from the fluid conduit into the well head comprises:

closing a base fluid outlet valve at a base fluid outlet of the fluid conduit that is fluidly connected to an inlet of the frac pump; and opening a base fluid inlet valve at a base fluid inlet of the fluid conduit that is fluidly connected to an outlet of the frac pump; and B4. The method of clause B1, wherein injecting the at least one material of the fracking fluid into the fluid conduit comprises injecting the at least one material into the fluid conduit from a material chamber of a syringe that is fluidly connected to the fluid conduit downstream from the frac pump.

B5. The method of clause B1, wherein injecting the at least one material of the fracking fluid into the fluid conduit comprises extending a piston of a syringe to push the at least one material from the syringe into the fluid conduit downstream from the frac pump.

B6. The method of clause B1, wherein injecting the at least one material of the fracking fluid into the fluid conduit comprises creating a lower-pressure state within the fluid conduit to draw the at least one material into the fluid conduit from a material source, and wherein pumping the fracking fluid from the fluid conduit into a well head comprises creating a higher-pressure state within the fluid conduit to push the fracking fluid from the fluid conduit into the well head.

Clause Set C:

C1. A hydraulic fracturing system comprising:

a material source;

a frac pump having a pump outlet and a pump inlet;

a fluid conduit having a fracking fluid outlet configured to be fluidly connected to a well head for delivering a fracking fluid to the well head, the fluid conduit comprising a base fluid inlet fluidly connected to the pump outlet of the frac pump such that the fluid conduit is configured to receive a flow of base fluid from the frac pump through the base fluid inlet; and an injection system fluidly connected to the material source for receiving a flow of at least one material of the fracking fluid from the material source, the injection system being fluidly connected to the fluid conduit downstream from the base fluid inlet and upstream from the fracking fluid outlet, wherein the injection system is configured to inject the at least one material of the fracking fluid into the fluid conduit downstream from the frac pump.

C2. The hydraulic fracturing system of clause C1, wherein the fluid conduit alternates between a lower-pressure state wherein the injection system draws the at least one material of the fracking fluid into the fluid conduit and a higher-pressure state wherein the fluid conduit delivers the fracking fluid to the well head.

C3. The hydraulic fracturing system of clause C1, wherein the injection system comprises a material inlet valve and a base fluid outlet valve, the fluid conduit comprising a base fluid inlet valve and a fracking fluid outlet valve, wherein the injection system is configured to draw the at least one material of the fracking fluid into the fluid conduit when the material inlet valve and the base fluid outlet valve are open and the base fluid inlet valve and the fracking fluid outlet valve are closed, and wherein the fluid conduit is configured to deliver the fracking fluid to the well head when the material inlet valve and the base fluid outlet valve are closed and the base fluid inlet valve and the fracking fluid outlet valve are open.

C4. The hydraulic fracturing system of clause C1, wherein the injection system comprises a syringe.

C5. The hydraulic fracturing system of clause C1, wherein the injection system comprises a syringe having a material chamber fluidly connected to the fluid conduit downstream from the frac pump, the material chamber being fluidly connected to the material source, the syringe comprising a piston that is configured to retract to draw the at least one material of the fracking fluid into the material chamber from the material source, the piston being configured to extend to push the at least one material of the fracking fluid from the material chamber into the fluid conduit downstream from the frac pump.

It is to be understood that the above description is intended to be illustrative, and not restrictive. For example, the above-described embodiments (and/or aspects thereof) can be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly can constitute an additional embodiment. In addition, many modifications can be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise", "left" and right", "front" and "rear", "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there can be additional elements other than the listed elements. For example, in this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised", "comprises", "having", "has", "includes", and "including" where they appear. The term "exemplary" is intended to mean "an example of" The phrase "one or more of the following: A, B, and C" means "at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations can be performed in any order, unless otherwise specified, and examples of the disclosure can include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A fluid delivery device for a hydraulic fracturing system, said fluid delivery device comprising:

a fluid conduit comprising a fracking fluid outlet fluidly connected to a well head for delivering a fracking fluid to the well head, a base fluid inlet fluidly connected to the outlet of a frac pump such that the fluid conduit is configured to receive a flow of base fluid from the frac pump through the base fluid inlet, and a mixing segment extending between the base fluid inlet to the fracking fluid outlet; and an injection system comprising a material inlet fluidly connecting a material source to the mixing segment, and a base fluid outlet fluidly connecting the mixing segment to an inlet of the frac pump, wherein the injection system is configured to alternatingly inject at least one material of the fracking fluid from the material source into the mixing segment downstream from the frac pump to generate the fracking fluid within the mixing segment for flow through the fracking fluid outlet, and to direct a flow of base fluid from the fluid conduit into the inlet of the frac pump.

2. The fluid delivery device of claim 1, wherein the fluid conduit alternates between a lower-pressure state wherein the injection system draws the at least one material of the fracking fluid into the fluid conduit from the material source and a higher-pressure state wherein the fluid conduit delivers the fracking fluid to the well head.

3. The fluid delivery device of claim 1, wherein the material inlet further comprises a material inlet valve, and the base fluid outlet further comprises a base fluid outlet valve;

wherein the injection system is configured to draw the at least one material of the fracking fluid into the fluid conduit from the material source when the material inlet valve and the base fluid outlet valve are open.

4. The fluid delivery device of claim 1, wherein the injection system comprises a material inlet valve and a base fluid outlet valve, the fluid conduit comprising a base fluid inlet valve and a fracking fluid outlet valve, wherein the injection system is configured to draw the at least one material of the fracking fluid into the fluid conduit when the material inlet valve and the base fluid outlet valve are open and the base fluid inlet valve and the fracking fluid outlet valve are closed, and wherein the fluid conduit is configured to deliver the fracking fluid to the well head when the material inlet valve and the base fluid outlet valve are closed and the base fluid inlet valve and the fracking fluid outlet valve are open.

5. The fluid delivery device of claim 1, wherein the fluid conduit is a first fluid conduit and the injection system is a first injection system, the fluid delivery device further comprising second and third fluid conduits and second and third injection systems fluidly connected to the second and third fluid conduits, respectively, the second and third injection systems configured to inject the at least one material of fracking fluid into the second and third fluid conduits downstream from the frac pump.

6. The fluid delivery device of claim 1, wherein the injection system comprises a syringe.

7. The fluid delivery device of claim 1, wherein the injection system comprises a syringe having a material chamber fluidly connected to the fluid conduit downstream from the frac pump, the material chamber being configured to be fluidly connected to the material source, the syringe comprising a piston that is configured to retract to draw the at least one material of the fracking fluid into the material chamber from the material source, the piston being configured to extend to push the at least one material of the fracking fluid from the material chamber into the fluid conduit downstream from the frac pump.

8. The fluid delivery device of claim 1, wherein the injection system comprises a syringe having a piston, an actuator, and a base fluid chamber, the base fluid chamber configured to be fluidly connected to the outlet of the frac pump, the actuator being configured to retract the piston, the base fluid chamber comprising a base fluid inlet valve configured to open such that base fluid pressure from the outlet of the frac pump extends the piston.

9. A method for operating a hydraulic fracturing system, said method comprising:

injecting at least one material of a fracking fluid into a fluid conduit;

pumping a base fluid from the outlet of a frac pump into the fluid conduit to generate the fracking fluid within the fluid conduit downstream from the frac pump;

pumping the fracking fluid from the fluid conduit through a fracking outlet valve into a well head;

closing the fracking fluid outlet valve; and opening a base fluid outlet valve to direct base fluid flowing in the fluid conduit to an inlet of the frac pump.

10. The method of claim 9, wherein injecting the at least one material of the fracking fluid into the fluid conduit comprises:

closing a base fluid inlet valve at a base fluid inlet of the fluid conduit that is fluidly connected to an outlet of the frac pump; and opening a base fluid outlet valve at a base fluid outlet of the fluid conduit that is fluidly connected to an inlet of the frac pump.

11. The method of claim 9, wherein pumping the fracking fluid from the fluid conduit into the well head comprises:

closing a base fluid outlet valve at a base fluid outlet of the fluid conduit that is fluidly connected to an inlet of the frac pump; and closing a material inlet valve at a material inlet of the fluid conduit that is fluidly connected to a material injection system;

opening a base fluid inlet valve at a base fluid inlet of the fluid conduit that is fluidly connected to an outlet of the frac pump; and opening a fracking fluid outlet valve at the fracking fluid outlet of the fluid conduit that is fluidly connected to the wellhead.

12. The method of claim 9, wherein injecting the at least one material of the fracking fluid into the fluid conduit comprises injecting the at least one material into the fluid conduit from a material chamber of a syringe that is fluidly connected to the fluid conduit downstream from the frac pump.

13. The method of claim 9, wherein injecting the at least one material of the fracking fluid into the fluid conduit comprises extending a piston of a syringe to push the at least one material from the syringe into the fluid conduit downstream from the frac pump.

14. The method of claim 9, wherein injecting the at least one material of the fracking fluid into the fluid conduit comprises creating a lower-pressure state within the fluid conduit to draw the at least one material into the fluid conduit from a material source, and wherein pumping the fracking fluid from the fluid conduit into the well head comprises creating a higher-pressure state within the fluid conduit to push the fracking fluid from the fluid conduit into the well head.

15. A hydraulic fracturing system comprising:

a material source;

a frac pump having a pump outlet and a pump inlet;

a fluid conduit having a fracking fluid outlet configured to be fluidly connected to a well head for delivering a fracking fluid to the well head, the fluid conduit comprising a base fluid inlet fluidly connected to the pump outlet of the frac pump such that the fluid conduit is configured to receive a flow of base fluid from the frac pump through the base fluid inlet; and an injection system fluidly connected to the material source for receiving a flow of at least one material of the fracking fluid from the material source, the injection system being fluidly connected to the fluid conduit downstream from the base fluid inlet and upstream from the fracking fluid outlet, wherein the injection system is configured to inject the at least one material of the fracking fluid into the fluid conduit downstream from the frac pump, the injection system comprising a base fluid outlet fluidly connected to the fluid conduit and configured to direct a flow of base fluid from the fluid conduit into the inlet of the frac pump.

16. The hydraulic fracturing system of claim 15, wherein the fluid conduit alternates between a lower-pressure state wherein the injection system draws the at least one material of the fracking fluid into the fluid conduit and a higher-pressure state wherein the fluid conduit delivers the fracking fluid to the well head.

17. The hydraulic fracturing system of claim 15, wherein the injection system comprises a material inlet valve and a base fluid outlet valve, the fluid conduit comprising a base fluid inlet valve and a fracking fluid outlet valve, wherein the injection system is configured to draw the at least one material of the fracking fluid into the fluid conduit when the material inlet valve and the base fluid outlet valve are open and the base fluid inlet valve and the fracking fluid outlet valve are closed, and wherein the fluid conduit is configured to deliver the fracking fluid to the well head when the material inlet valve and the base fluid outlet valve are closed and the base fluid inlet valve and the fracking fluid outlet valve are open.

18. The hydraulic fracturing system of claim 15, wherein the injection system comprises a syringe.

19. The hydraulic fracturing system of claim 15, wherein the injection system comprises a syringe having a material chamber fluidly connected to the fluid conduit downstream from the frac pump, the material chamber being fluidly connected to the material source, the syringe comprising a piston that is configured to retract to draw the at least one material of the fracking fluid into the material chamber from the material source, the piston being configured to extend to push the at least one material of the fracking fluid from the material chamber into the fluid conduit downstream from the frac pump.

* * * * *